US011891994B2

(12) United States Patent
Lee et al.

(10) Patent No.: US 11,891,994 B2
(45) Date of Patent: Feb. 6, 2024

(54) SCROLL COMPRESSOR

(71) Applicant: Hanon Systems, Daejeon (KR)

(72) Inventors: Kyung Jae Lee, Daejeon (KR); Jeong Ki Seo, Daejeon (KR)

(73) Assignee: HANON SYSTEMS, Daejeon (KR)

( * ) Notice: Subject to any disclaimer, the term of this patent is extended or adjusted under 35 U.S.C. 154(b) by 68 days.

(21) Appl. No.: 17/753,067

(22) PCT Filed: Aug. 11, 2020

(86) PCT No.: PCT/KR2020/010596

§ 371 (c)(1),
(2) Date: Feb. 17, 2022

(87) PCT Pub. No.: WO2021/040271

PCT Pub. Date: Mar. 4, 2021

(65) Prior Publication Data

US 2022/0290668 A1 Sep. 15, 2022

(30) Foreign Application Priority Data

Aug. 27, 2019 (KR) ..... 10-2019-0105343

(51) Int. Cl.
*F03C 2/00* (2006.01)
*F03C 4/00* (2006.01)
(Continued)

(52) U.S. Cl.
CPC ..... *F04C 18/0215* (2013.01); *F04C 29/124* (2013.01); *F04C 2210/26* (2013.01); *F04C 2240/20* (2013.01); *F04C 2240/30* (2013.01)

(58) Field of Classification Search
CPC ..... F04C 18/0215; F04C 18/0253; F04C 23/008; F04C 28/24; F04C 2240/20;
(Continued)

(56) References Cited

U.S. PATENT DOCUMENTS

2016/0230765 A1 8/2016 Watanabe et al.
2018/0087508 A1 3/2018 Tsubai et al.

FOREIGN PATENT DOCUMENTS

EP 2644892 A2 10/2013
JP 07035081 A * 2/1995 ..... F04C 29/12
(Continued)

OTHER PUBLICATIONS

JP2015086704A—Hasegawa et al.—Scroll Compressor—May 7, 2015—English machine Translation. (Year: 2015).*

*Primary Examiner* — Theresa Trieu
(74) *Attorney, Agent, or Firm* — Shumaker, Loop & Kendrick, LLP; James D. Miller

(57) ABSTRACT

A scroll compressor includes a housing; a motor provided in the housing; a rotating shaft rotated by the motor; an orbiting scroll orbitally moved by the rotating shaft; a fixed scroll forming a compression chamber together with the orbiting scroll; and a valve mechanism guiding intermediate pressure refrigerant from an outside of the housing to the compression chamber and discharging refrigerant overcompressed in the compression chamber into a discharge chamber, thereby increasing amount of refrigerant discharged from the compression chamber, and improving performance and efficiency.

10 Claims, 21 Drawing Sheets

(51) Int. Cl.

| | |
|---|---|
| ***F04C 2/00*** | (2006.01) |
| ***F04C 18/00*** | (2006.01) |
| ***F04C 18/02*** | (2006.01) |
| ***F04C 29/12*** | (2006.01) |

(58) Field of Classification Search
CPC .. F04C 2240/30; F04C 29/00; F04C 29/0007; F04C 29/12; F04C 29/124; F04C 29/126; F04C 29/128; F04C 2210/26
See application file for complete search history.

(56) References Cited

FOREIGN PATENT DOCUMENTS

| | | | | | |
|---|---|---|---|---|---|
| JP | 08303361 | A | * | 11/1996 | ..... F04C 29/12 |
| JP | 2012184750 | A | | 9/2012 | |
| JP | 2013209923 | A | | 10/2013 | |
| JP | 2015021415 | A | | 2/2015 | |
| JP | 2015086704 | A | | 5/2015 | |
| KR | 20040091362 | A | | 10/2004 | |
| KR | 100504889 | B1 | | 7/2005 | |
| KR | 101921833 | B1 | | 11/2018 | |
| WO | WO-2007116989 | A1 | * | 10/2007 | ..... F04B 39/023 |

* cited by examiner

SCROLL COMPRESSOR

CROSS-REFERENCE TO RELATED PATENT APPLICATIONS

This patent application is a United States nation phase patent application based on PCT/KR2020/010596 filed on Aug. 11, 2020, which claims the benefit of Korean Patent Application No. 10-2019-0105343 filed on Aug. 27, 2019, the entire disclosures of which are hereby incorporated herein by reference.

TECHNICAL FIELD

The present disclosure relates to a scroll compressor, and more particularly, to a scroll compressor capable of compressing a refrigerant with a fixed scroll and an orbiting scroll.

BACKGROUND ART

In general, an air conditioning device (A/C) for heating and cooling an interior is installed in a vehicle. The air conditioning device is a component of a cooling system, and includes a compressor compressing a low-temperature and low-pressure gaseous refrigerant introduced from an evaporator into a high-temperature and high-pressure gaseous refrigerant and sending it to a condenser.

The compressor includes a reciprocating type compressing a refrigerant through a reciprocating motion of a piston, and a rotary type performing compression while rotating. According to a power transmission method, the reciprocating type includes a crank type transmitting power to a plurality of pistons using a crank, a swash plate type transmitting power to a rotating shaft on which a swash plate installed, and the like, and wherein the rotary type includes a vane rotary type using a rotating rotary shaft and vanes, and a scroll type using orbiting scroll and fixed scroll.

A scroll compressor is widely used for refrigerant compression in air conditioning devices due to its advantages of obtaining a relatively high compression ratio compared to other types of compressors and obtaining a stable torque through smooth refrigerant suction, compression and discharge strokes.

FIG. 1 is a cross-sectional view showing a conventional scroll compressor.

Referring to FIG. 1, the conventional scroll compressor includes a housing 100, a motor 200 provided in the housing 100, a rotating shaft 300 rotated by the motor 200, an orbiting scroll 400 orbitally moved by the rotating shaft 300, and a fixed scroll 500 forming a compression chamber C with the orbiting scroll 400.

In the conventional scroll compressor according to this configuration, when power is applied to the motor 200, the rotating shaft 300 rotates together with a rotor of the motor 200, and the orbiting scroll 400 is orbitally moved by the rotating shaft 300 and, the refrigerant is sucked into the compression chamber C, compressed in the compression chamber C, and discharged from the compression chamber C by the orbitally movement of the orbiting scroll 400.

However, in the conventional scroll compressor, an amount of refrigerant discharged from the compression chamber C is determined, and there is a limit in improving the performance and efficiency of the compressor.

SUMMARY

Accordingly, an object of the present disclosure is to provide a scroll compressor capable of improving the performance and efficiency of the compressor by increasing an amount of refrigerant discharged from a compression chamber.

In order to achieve the object as described above, the present disclosure provides a scroll compressor including a housing; a motor provided in the housing; a rotating shaft rotated by the motor; an orbiting scroll orbitally moved by the rotating shaft; a fixed scroll forming a compression chamber together with the orbiting scroll; and a valve mechanism guiding intermediate pressure refrigerant from an outside of the housing to the compression chamber and discharging refrigerant overcompressed in the compression chamber into a discharge chamber.

The scroll compressor may further include an injection flow path guiding the intermediate pressure refrigerant from the outside of the housing to the compression chamber, and a pre-outlet flow path discharging the refrigerant overcompressed in the compression chamber to the discharge chamber, wherein a part of the injection flow path and a part of the pre-outlet flow path may be shared with each other by the valve mechanism.

The valve mechanism may include a first flow path through which the intermediate pressure refrigerant flows, a chamber communicating with the first flow path, a second flow path communicating the chamber and the compression chamber, a third flow path communicating the chamber and the discharge chamber, a first valve opening and closing the first flow path, and a second valve opening and closing the third flow path.

The first valve may be formed to open the first flow path when the pressure of the chamber is lower than the intermediate pressure, and to close the first flow path when the pressure in the chamber is higher than the intermediate pressure.

The second valve may be formed to open the third flow path when the pressure of the chamber is higher than the pressure of the discharge chamber, and to close the third flow path when the pressure in the chamber is lower than the pressure in the discharge chamber.

The valve mechanism may further include a cover plate having the first flow path, and a valve plate having the chamber, the second flow path and the third flow path.

The first valve may be interposed between the cover plate and the valve plate.

The second valve may be formed inside the third flow path.

The first valve may include a head opening and closing an outlet of the first flow path, a leg supporting the head, and a periphery supporting the leg, and the chamber may include a retainer surface supporting the head and the leg when the first valve opens the first flow path.

An inlet of the third flow path may be formed on the retainer surface.

A portion of the inlet of the third flow path may be formed at a position opposite to at least one of the head and the leg on the retainer surface.

The remaining portion of the inlet of the third flow path may be formed at a position not opposite the head and the leg on the retainer surface.

The second valve may include a seat member including a first hole communicating with an inlet of the third flow path and a second hole having a larger diameter than the first hole and communicating with an outlet of the third flow path, a valve member having a diameter larger than the first hole and smaller than the second hole, reciprocating inside the second hole, and communicating and blocking the first hole and the second hole, and an elastic member pressing the valve member toward the first hole, wherein the fixed scroll may include a discharge hole communicating the compression chamber and the discharge chamber, and a communication hole communicating the compression chamber and the second flow path.

A discharge valve may be formed in the fixed scroll, and may include an opening/closing portion for opening and closing the discharge hole, a fastening portion fastened to the fixed scroll, and a supporting portion extending from the opening/closing portion to the fastening portion, and the opening/closing portion, the fastening portion and the supporting portion may be each formed as one.

A scroll compressor according to the present disclosure includes a housing; a motor provided in the housing; a rotating shaft rotated by the motor; an orbiting scroll orbitally moved by the rotating shaft; a fixed scroll forming a compression chamber together with the orbiting scroll; and a valve mechanism guiding intermediate pressure refrigerant from an outside of the housing to the compression chamber and discharging refrigerant overcompressed in the compression chamber into a discharge chamber, thereby increasing amount of refrigerant discharged from the compression chamber, and improving performance and efficiency.

DETAILED DESCRIPTION OF AN EMBODIMENT

Hereinafter, a scroll compressor according to the present disclosure will be described in detail with reference to the accompanying drawings.

Figure 1:
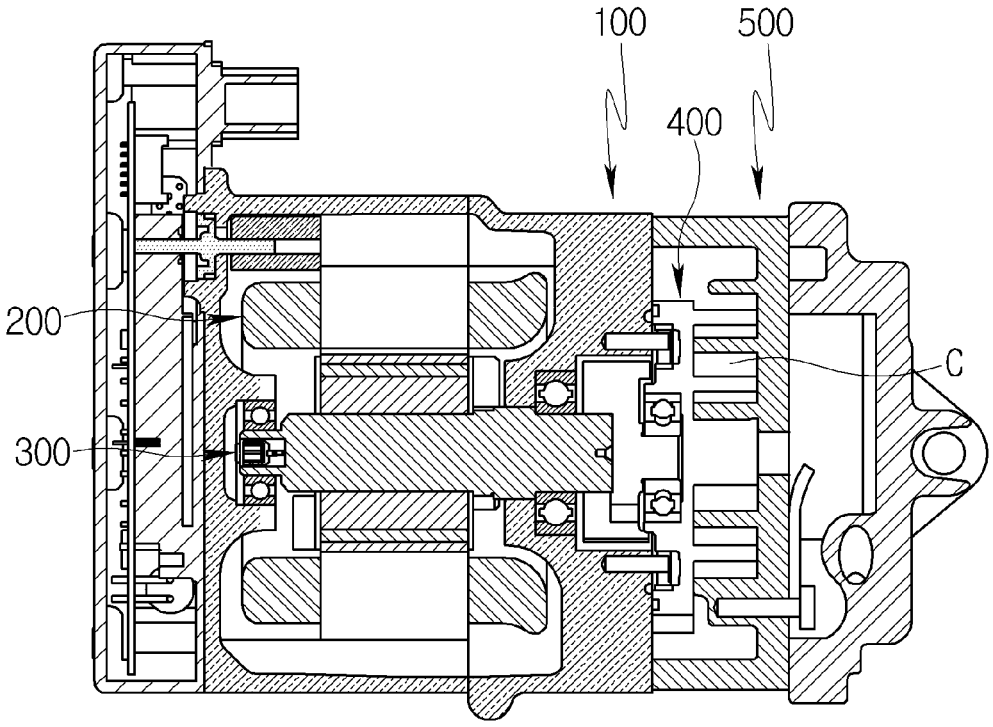
Fig. 1 PRIOR ART
FIG. 1 is a cross-sectional view showing a conventional scroll compressor.
Figure 2:
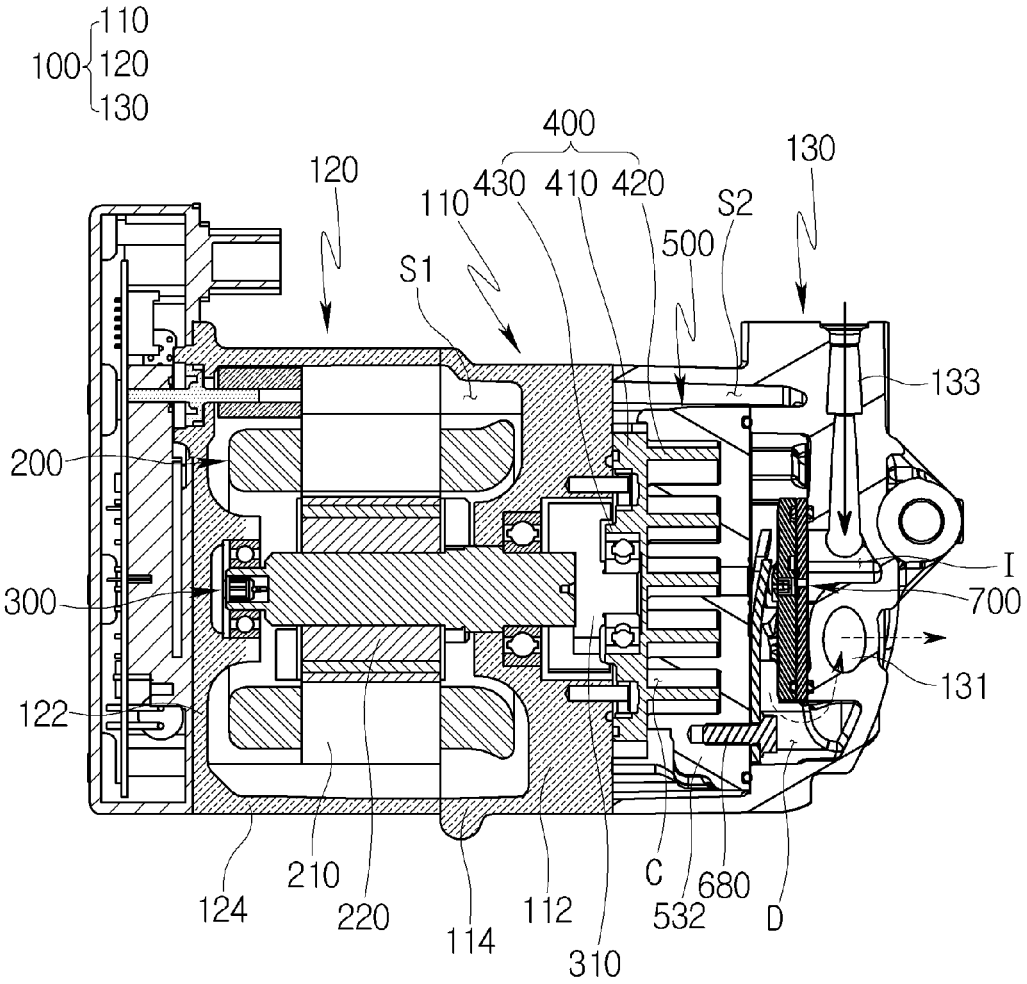
FIG. 2 is a cross-sectional view showing a scroll compressor according to an embodiment of the present disclosure.
Figure 3:
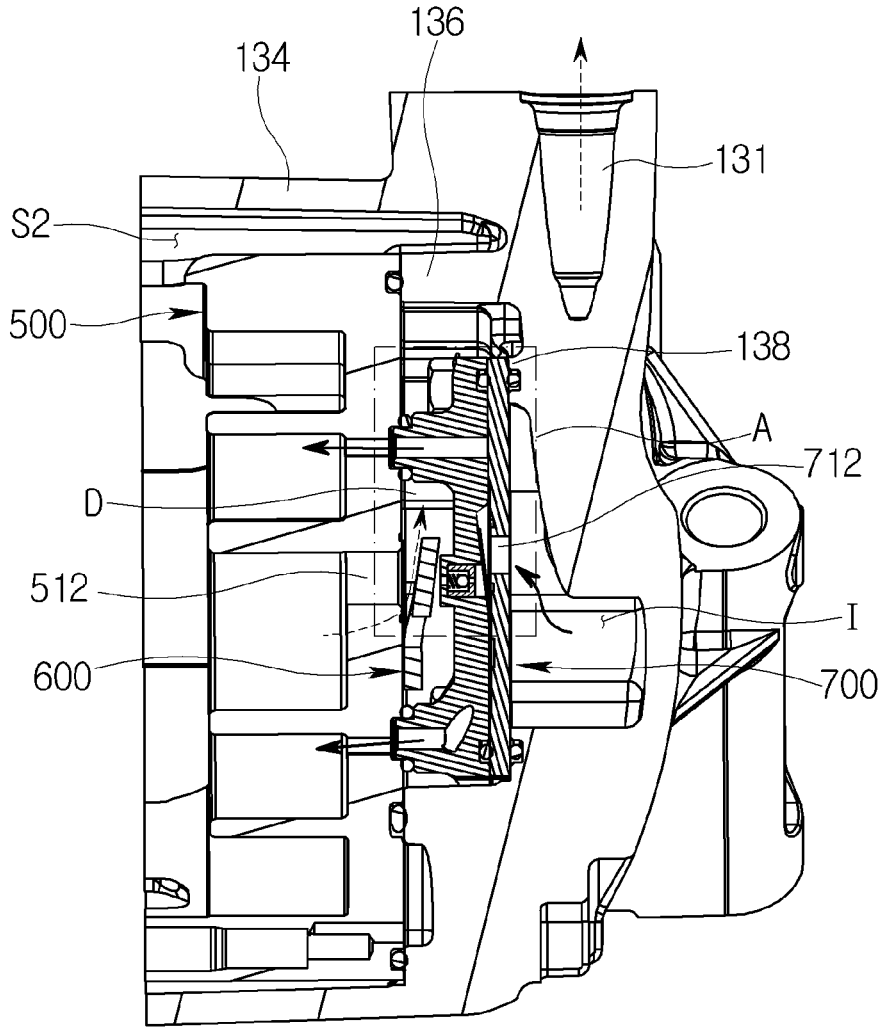
FIG. 3 is a cross-sectional view showing a rear housing side of the scroll compressor of FIG. 2 from another direction.
Figure 4:
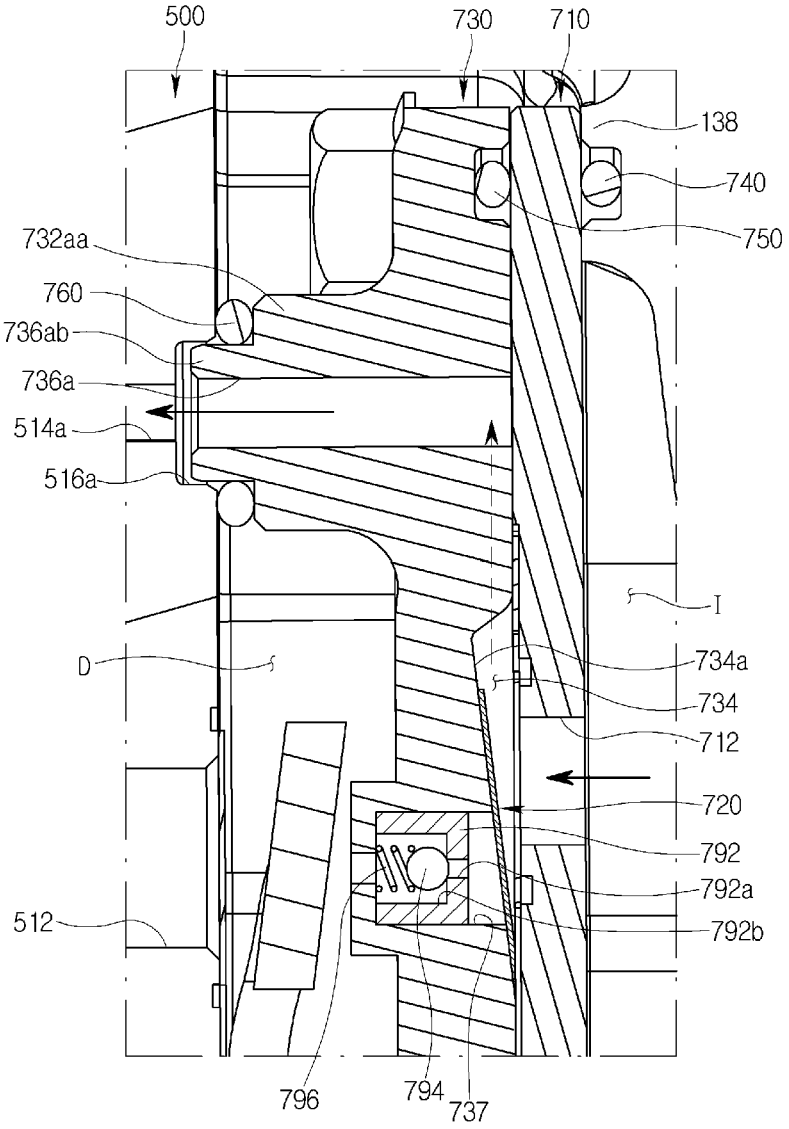
FIG. 4 is an enlarged cross-sectional view of part A of FIG. 3 when pressure of a chamber is lower than intermediate pressure.
Figure 5:
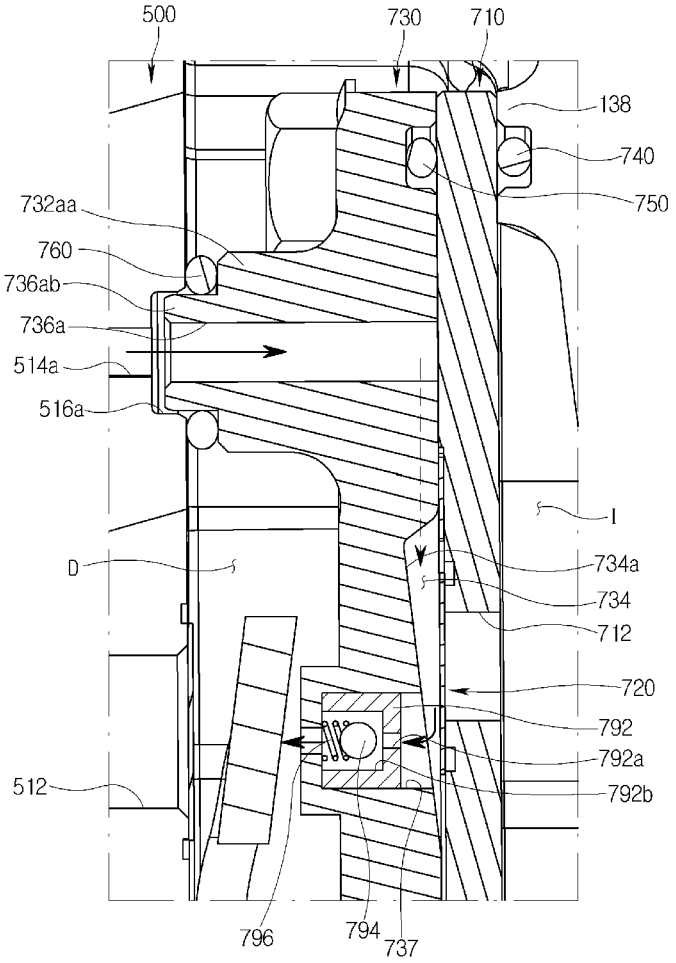
FIG. 5 is an enlarged cross-sectional view of part A of FIG. 3 when the pressure of the chamber is higher than pressure of a discharge chamber.
Figure 6:
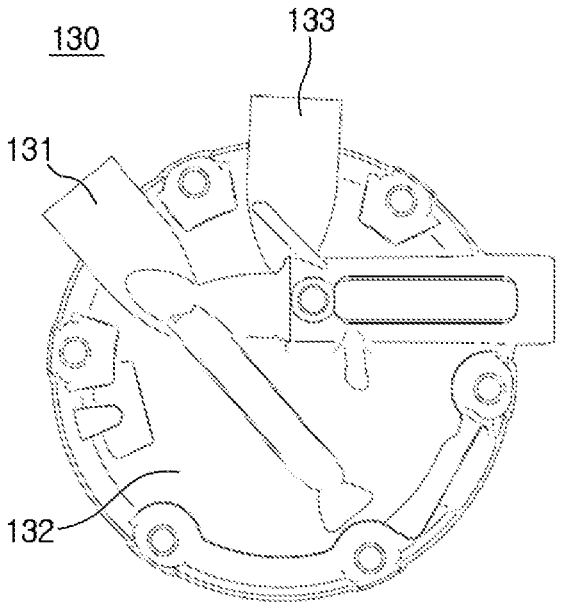
FIG. 6 is a front view showing the rear housing in the scroll compressor of FIG. 2.
Figure 7:
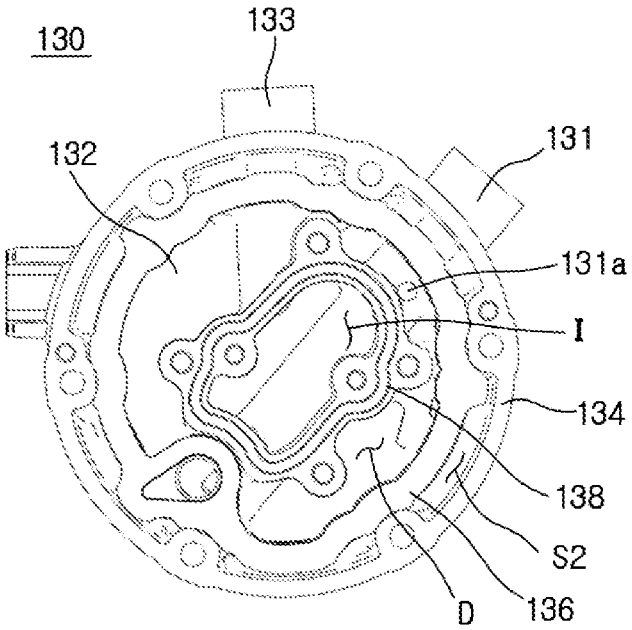
FIG. 7 is a rear view of FIG. 6.
Figure 8:
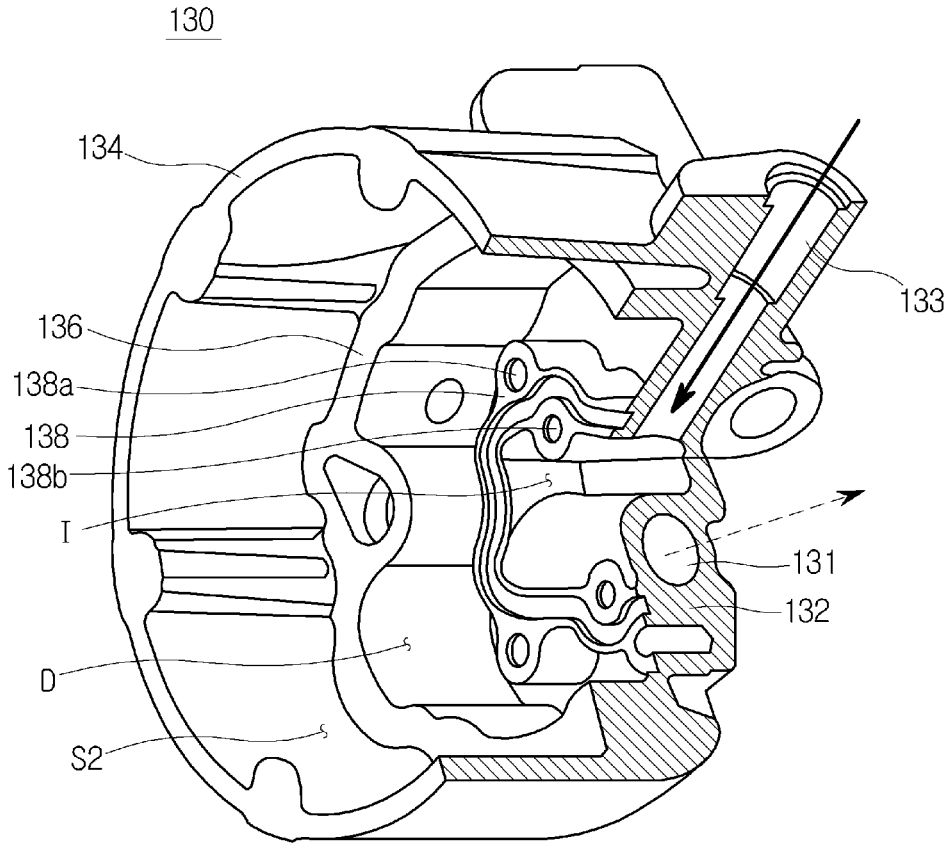
FIG. 8 is a perspective view of FIG. 7.
Figure 9:
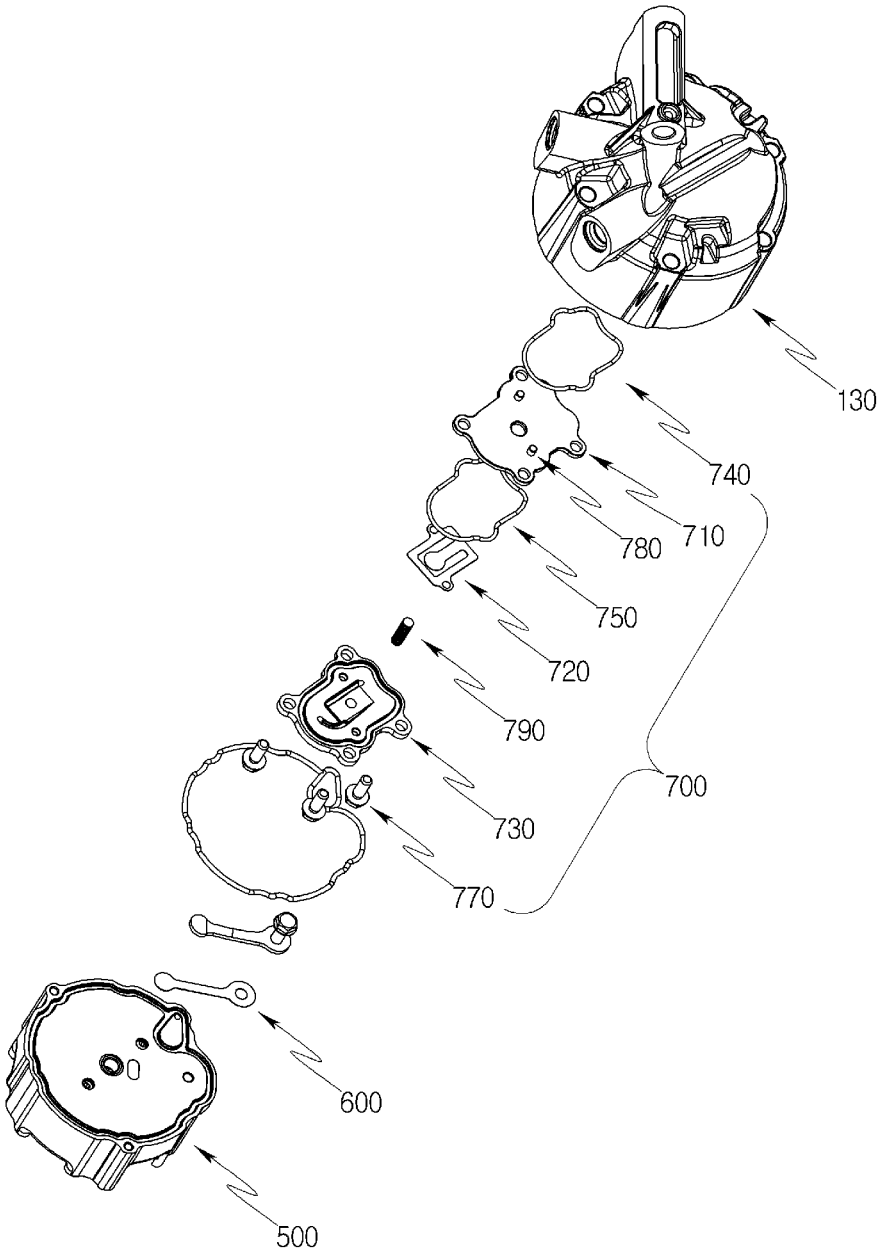
FIG. 9 is an exploded perspective view showing parts accommodated in the rear housing of FIG. 8.
Figure 10:
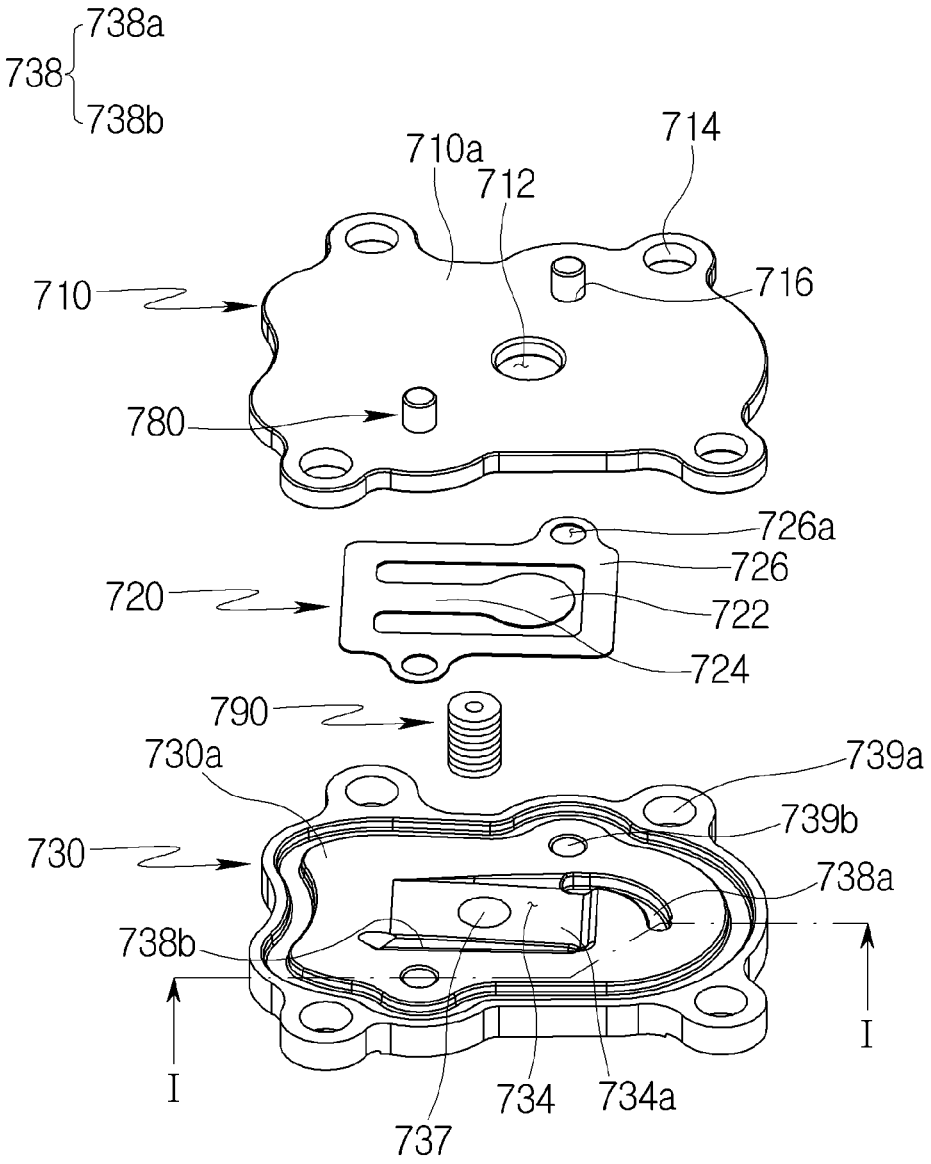
FIG. 10 is an exploded perspective view showing a valve mechanism among the parts of FIG. 9.
Figure 11:
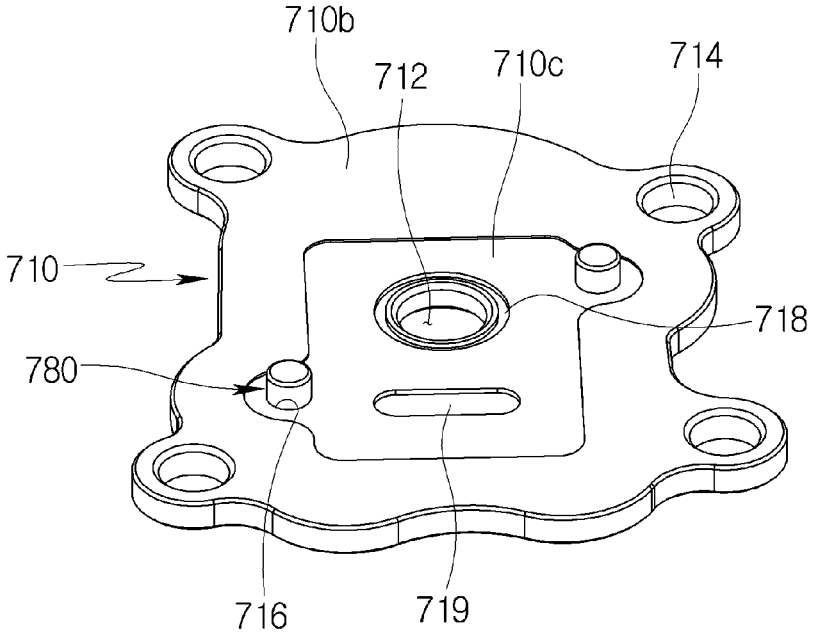
FIG. 11 is a perspective view showing a rear surface of a cover plate of the valve mechanism of FIG. 10.
Figure 12:
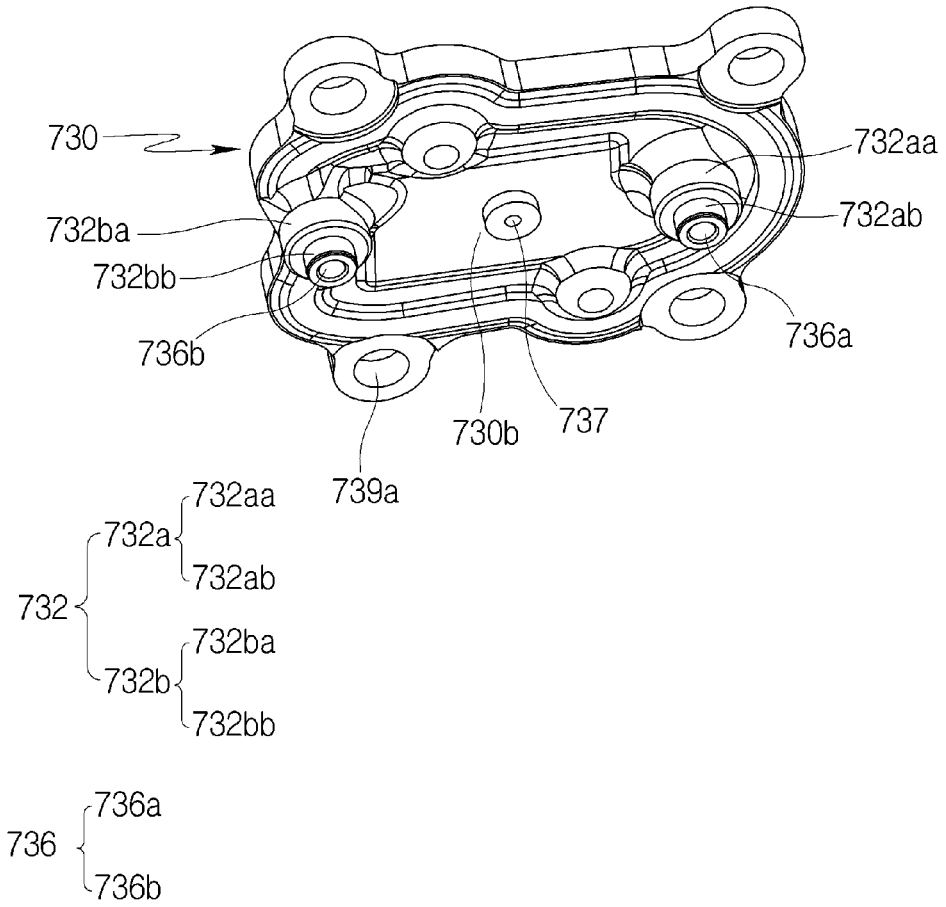
FIG. 12 is a perspective view showing a rear surface of a valve plate of the valve mechanism of FIG. 10.
Figure 13:
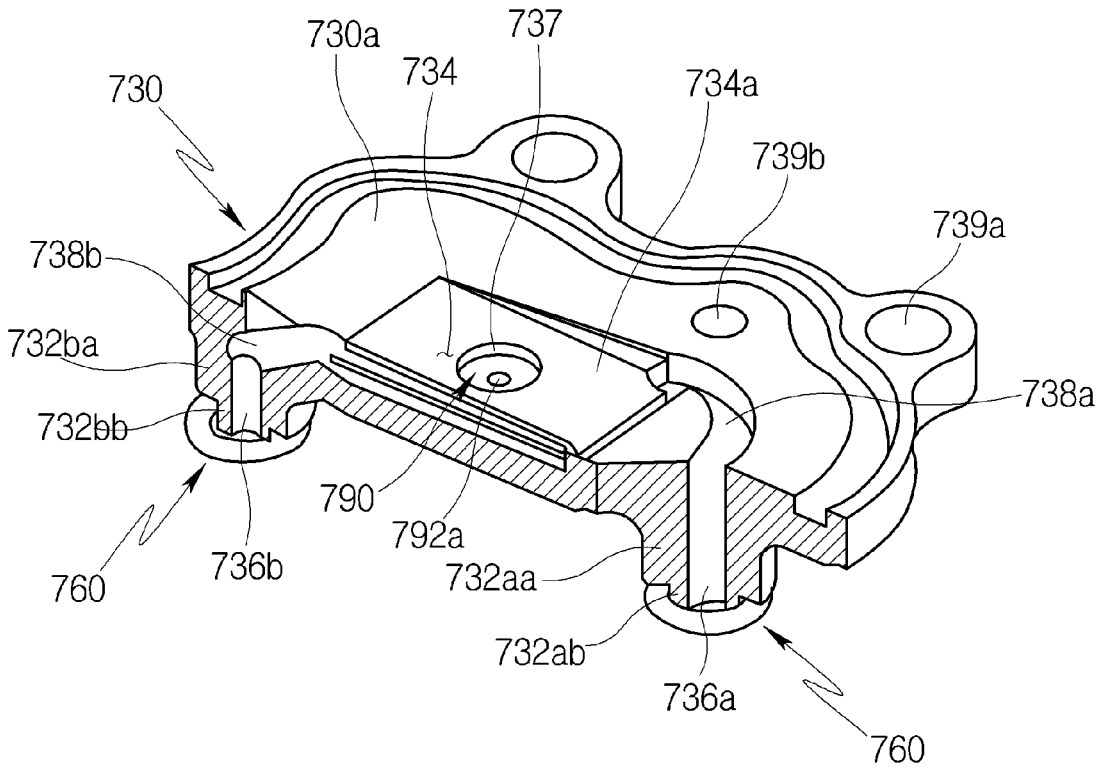
FIG. 13 is a perspective view taken along line I-I of FIG. 10.
Figure 14:
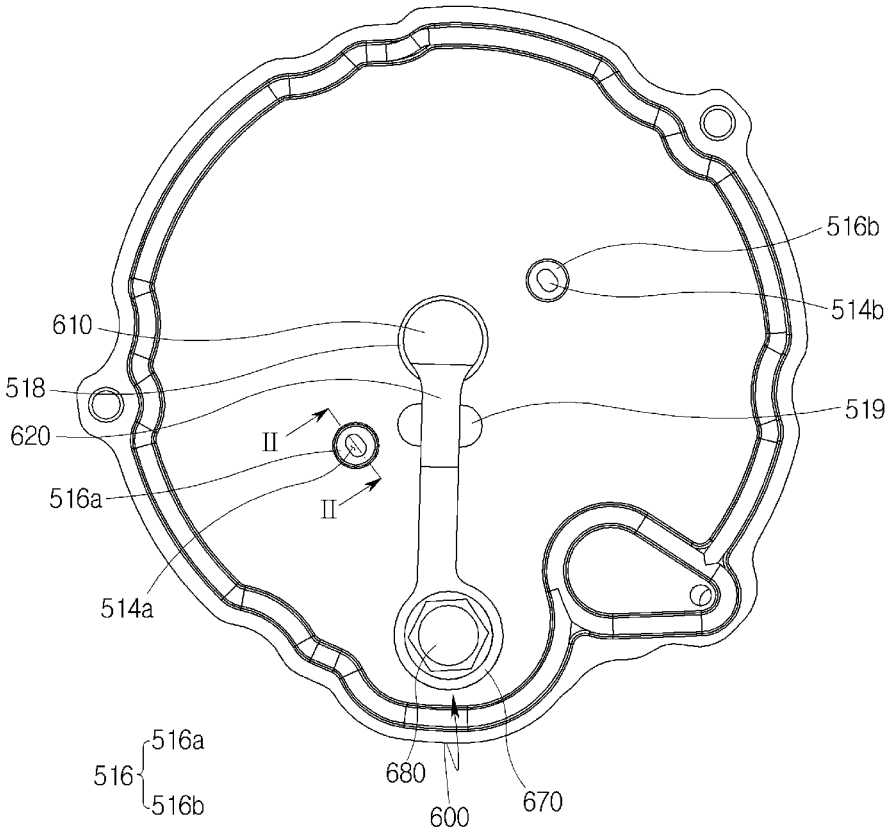
FIG. 14 is a front view showing a fixed scroll and a discharge valve among the parts of FIG. 9.
Figure 15:
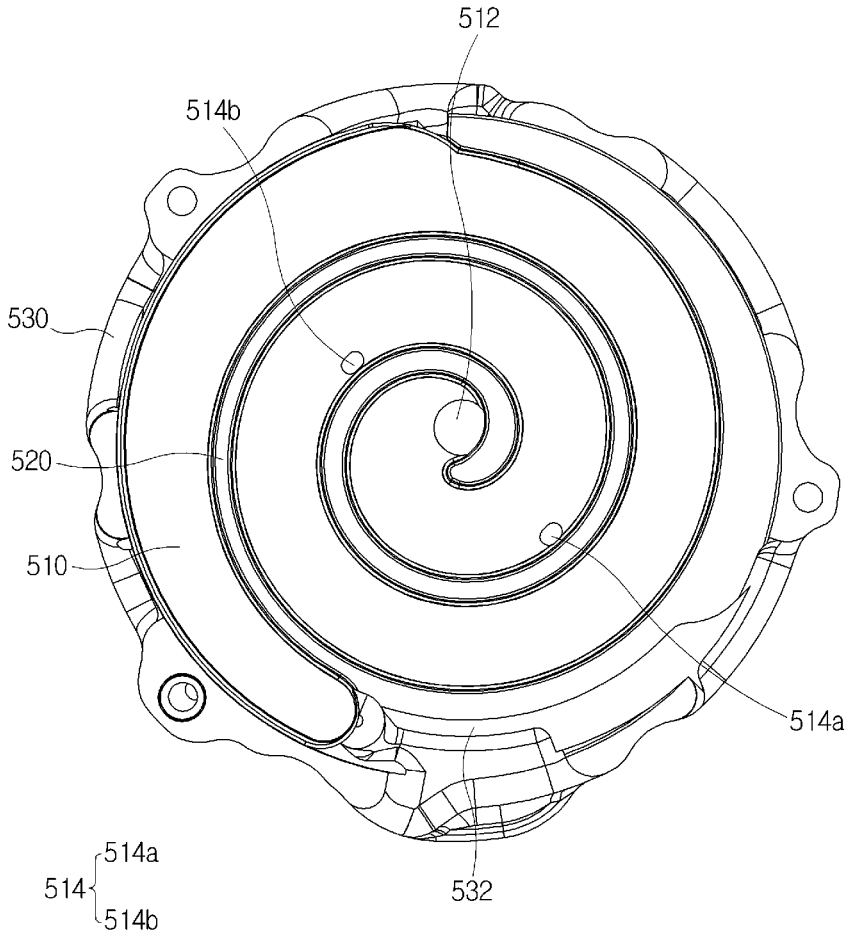
FIG. 15 is a rear view of FIG. 14.
Figure 16:
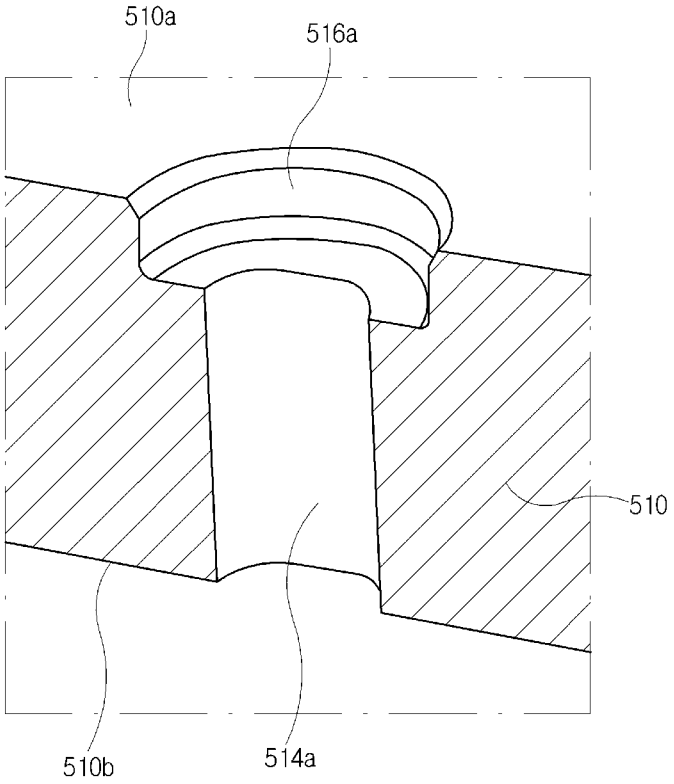
FIG. 16 is a perspective view taken along line II-II of FIG. 14.

FIG. 2 is a cross-sectional view showing a scroll compressor according to an embodiment of the present disclosure, FIG. 3 is a cross-sectional view showing a rear housing side of the scroll compressor of FIG. 2 from another direction, FIG. 4 is an enlarged cross-sectional view of part A of FIG. 3 when pressure of a chamber is lower than intermediate pressure, FIG. 5 is an enlarged cross-sectional view of part A of FIG. 3 when the pressure of the chamber is higher than pressure of a discharge chamber, FIG. 6 is a front view showing the rear housing in the scroll compressor of FIG. 2, FIG. 7 is a rear view of FIG. 6, FIG. 8 is a perspective view of FIG. 7, FIG. 9 is an exploded perspective view showing parts accommodated in the rear housing of FIG. 8, FIG. 10 is an exploded perspective view showing a valve mechanism among the parts of FIG. 9, FIG. 11 is a perspective view showing a rear surface of a cover plate of the valve mechanism of FIG. 10, FIG. 12 is a perspective view showing a rear surface of a valve plate of the valve mechanism of FIG. 10, FIG. 13 is a perspective view taken along line I-I of FIG. 10, FIG. 14 is a front view showing a fixed scroll and a discharge valve among the parts of FIG. 9, FIG. 15 is a rear view of FIG. 14, and FIG. 16 is a perspective view taken along line II-II of FIG. 14.

Figure 17:
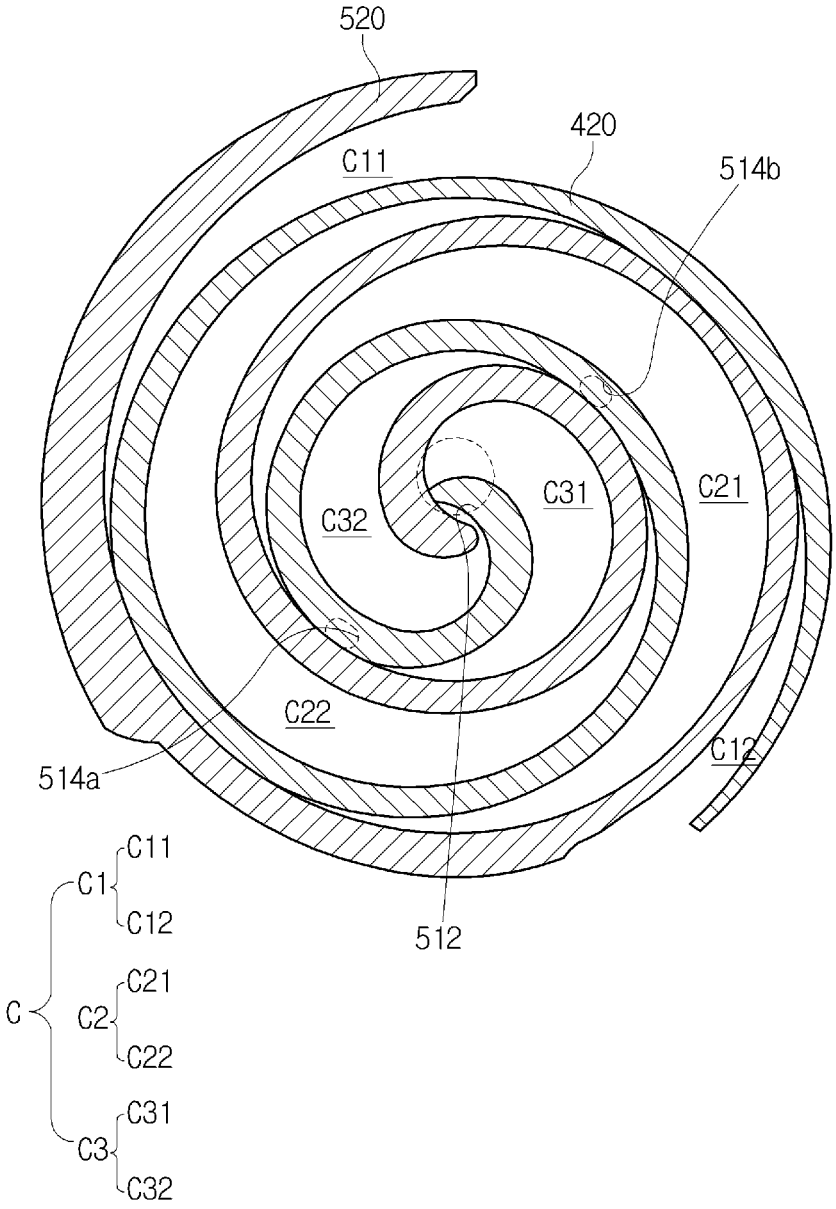
FIG. 17 is a cross-sectional view showing a fixed wrap, an orbiting wrap and a communication hole when a rotation angle of the rotating shaft is a first angle to explain an opening and closing operation of the communication hole of FIG. 14.
Figure 18:
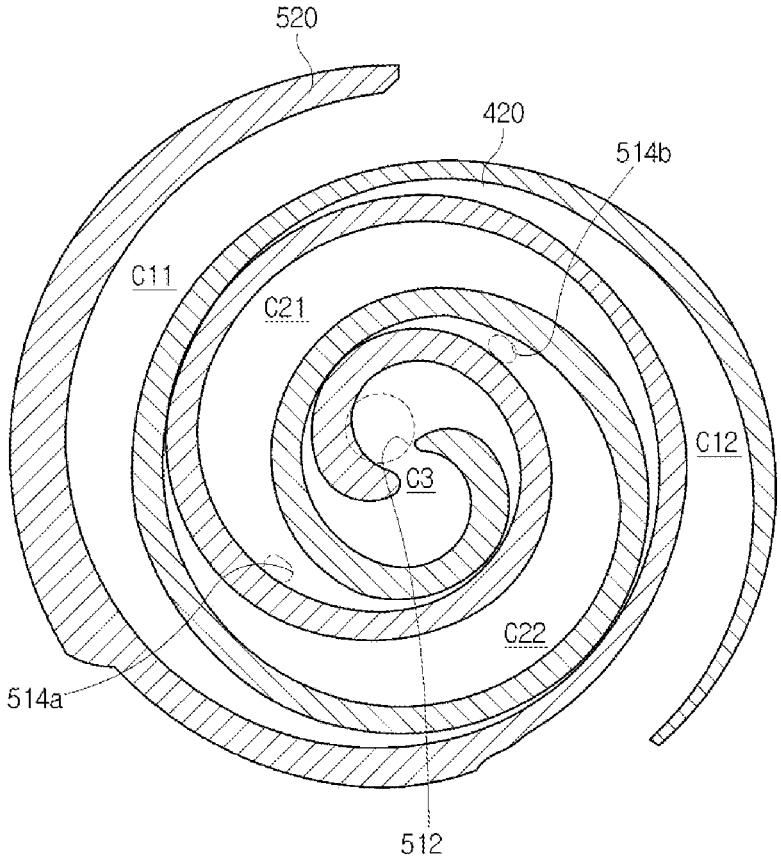
FIG. 18 is a cross-sectional view showing the fixed wrap, orbiting wrap and communication hole when the rotation angle of the rotating shaft is a second angle to explain the opening and closing operation of the communication hole of FIG. 14.
Figure 19:
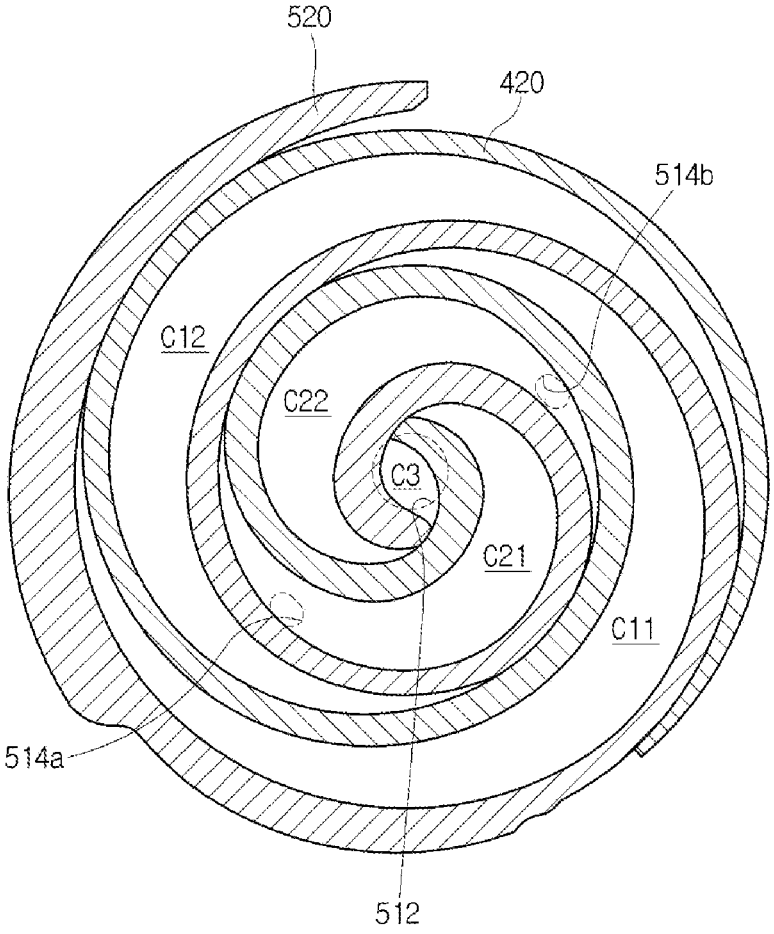
FIG. 19 is a cross-sectional view showing the fixed wrap, orbiting wrap and communication hole when the rotation angle of the rotating shaft is a third angle to explain the opening and closing operation of the communication hole of FIG. 14.
Figure 20:
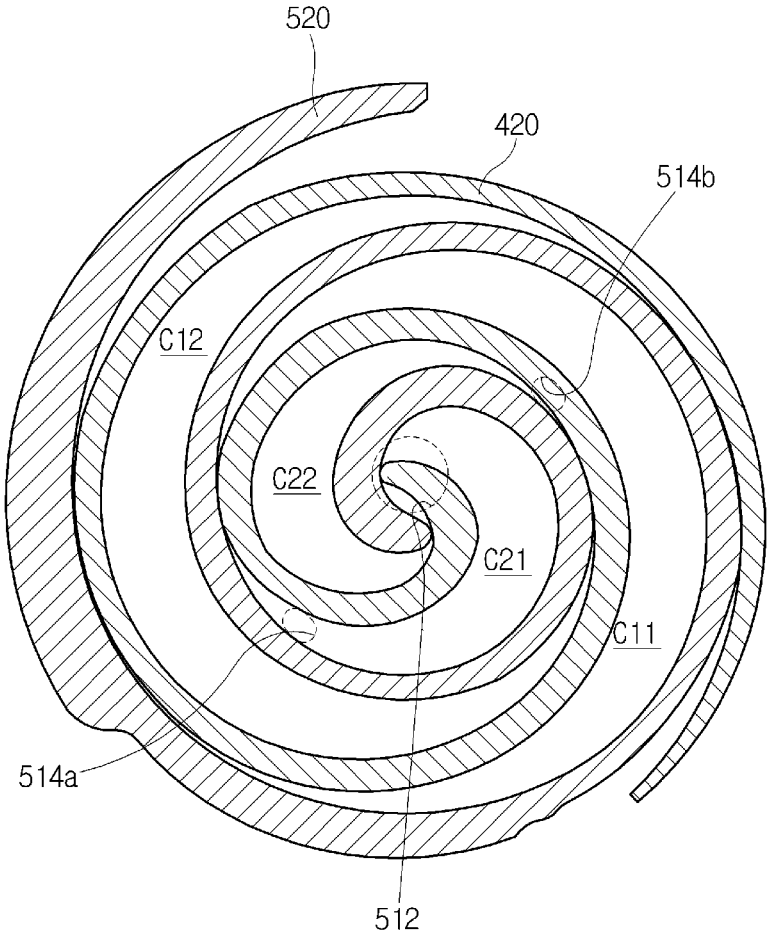
FIG. 20 is a cross-sectional view showing the fixed wrap, orbiting wrap and communication hole when the rotation angle of the rotating shaft is a fourth angle to explain the opening and closing operation of the communication hole of FIG. 14.
Figure 21:
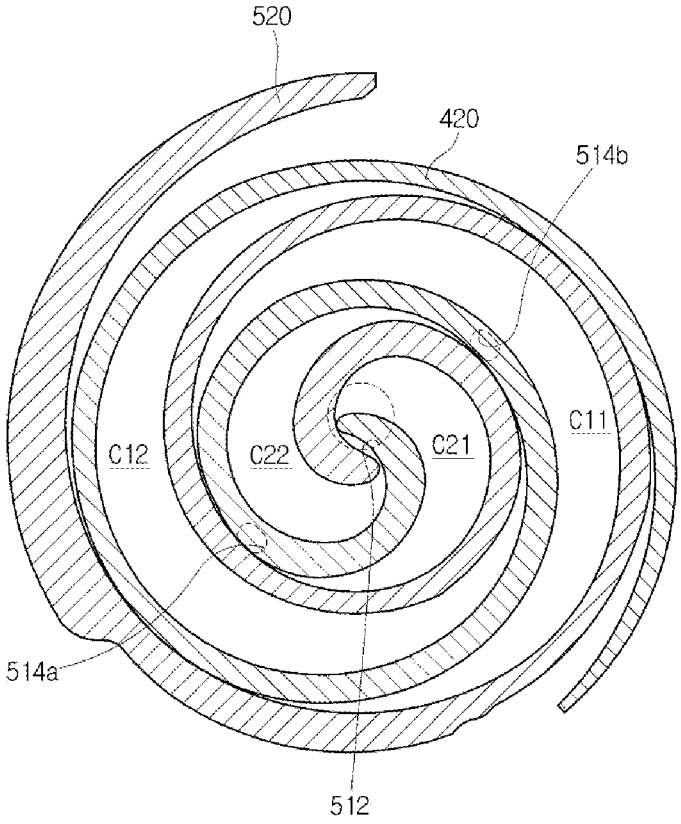
FIG. 21 is a cross-sectional view showing the fixed wrap, orbiting wrap and communication hole when the rotation angle of the rotating shaft is a fifth angle to explain the opening and closing operation of the communication hole of FIG. 14.

In addition, FIG. 17 is a cross-sectional view showing a fixed wrap, an orbiting wrap and a communication hole when a rotation angle of the rotating shaft is a first angle to explain an opening and closing operation of the communication hole of FIG. 14, FIG. 18 is a cross-sectional view showing the fixed wrap, orbiting wrap and communication hole when the rotation angle of the rotating shaft is a second angle to explain the opening and closing operation of the communication hole of FIG. 14, FIG. 19 is a cross-sectional view showing the fixed wrap, orbiting wrap and communication hole when the rotation angle of the rotating shaft is a third angle to explain the opening and closing operation of the communication hole of FIG. 14, FIG. 20 is a cross-sectional view showing the fixed wrap, orbiting wrap and communication hole when the rotation angle of the rotating shaft is a fourth angle to explain the opening and closing operation of the communication hole of FIG. 14, and FIG.

21 is a cross-sectional view showing the fixed wrap, orbiting wrap and communication hole when the rotation angle of the rotating shaft is a fifth angle to explain the opening and closing operation of the communication hole of FIG. 14.

Figure 22:
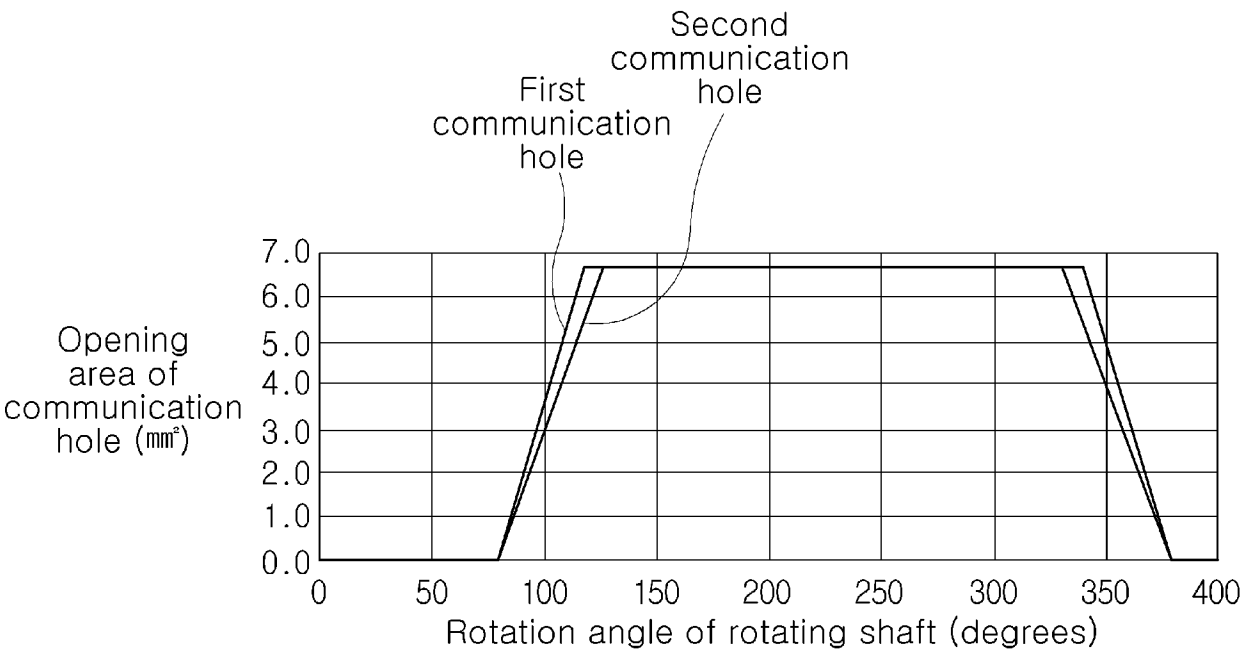
FIG. 22 is a diagram showing an opening and closing timing of the communication hole of FIG. 14.

In addition, FIG. 22 is a diagram showing an opening and closing timing of the communication hole of FIG. 14.

Referring to FIGS. 2 to 22, a scroll compressor according to an embodiment of the present disclosure may include a housing 100, a motor 200 provided in the housing 100, a rotating shaft 300 rotated by the motor 200, an orbiting scroll 400 orbitally moved by the rotating shaft 300, and a fixed scroll 500 forming a compression chamber C together with the orbiting scroll 400.

And, the scroll compressor according to this embodiment may further include an injection flow path guiding intermediate pressure refrigerant from an outside of the housing 100 (in a vapor compression refrigeration cycle including the scroll compressor, a condenser, an expansion valve and an evaporator, for example downstream of the condenser) into the compression chamber C, a pre-outlet flow path sharing a part of the injection flow path and discharging refrigerant overcompressed in the compression chamber C to discharge chamber D, and a valve mechanism 700 opening and closing the injection flow path and the pre-outlet flow path.

Here, the injection flow path may be extended from a rear housing 130 to be described later to the fixed scroll 500 by including an introduction port 133, an introduction chamber I, a first flow path 712, a chamber 734, a connection flow path 738, a second flow path 736 and a communication hole 514 to be described later. And, the pre-outlet flow path may be extended from the fixed scroll 500 to the discharge chamber D by including a communication hole 514, a second flow path 736, a connection flow path 738, a chamber 734, and a third flow path 737 to be described later. And, the valve mechanism 700 may include a first flow path 712, a chamber 734, a connection flow path 738, a second flow path 736, a third flow path 737, a first valve 720 and a second valve 790 to be described later, and may be interposed between a rear housing 130 to be described later and the fixed scroll 500.

Specifically, as shown in FIG. 2, the housing 100 may include a center housing 110 through which the rotating shaft 300 passes, a front housing 120 forming a motor accommodating space S1 in which the motor 200 is accommodated together with the center housing 110, and a rear housing 130 forming a scroll accommodating space S2 in which the orbiting scroll 400 and the fixed scroll 500 are accommodated together with the center housing 110.

The center housing 110 may include a center base plate 112 partitioning the motor accommodating space S1 and the scroll accommodating space S2 and supporting the orbiting scroll 400 and the fixed scroll 500, and a center side plate 114 protruding from an outer periphery of the center base plate 112 toward the front housing 120.

The center base plate 112 is formed in a substantially circular plate shape, and a shaft hole through which one end of the rotating shaft 300 passes and a back pressure chamber pressing the orbiting scroll 400 to the fixed scroll 500 may be formed in a center portion of the center base plate 112. Here, an eccentric bush 310 for converting rotational motion of the rotating shaft 300 into orbital motion of the orbiting scroll 400 is formed at one end of the rotating shaft 300, and the back pressure chamber also provides a space for rotation of the eccentric bush 310.

In addition, a suction flow path (not illustrated) guiding refrigerant flowing into the motor accommodating space S1 to the scroll accommodating space S2, as will be described later, may be formed on the outer periphery of the center base plate 112.

The front housing 120 may include a front base plate 122 facing the center base plate 112 and supporting the other end of the rotating shaft 300, and a front side plate 124 protruding from an outer periphery of the front base plate 122, coupled to the center side plate 114, and supporting the motor 200.

Here, the center base plate 112, the center side plate 114, the front base plate 122, and the front side plate 124 may form the motor accommodating space S1.

In addition, a suction port (not illustrated) guiding refrigerant having suction pressure from an outside to the motor accommodating space S1 may be formed on the front side plate 124.

As shown in FIGS. 2, 3 and 6 to 9, the rear housing 130 may include the discharge chamber D receiving the refrigerant discharged from the compression chamber C, a discharge port 131 guiding the refrigerant of the discharge chamber D to the outside of the housing 100, an introduction port 133 into which intermediate pressure refrigerant is introduced from the outside of the housing 100, and an introduction chamber I accommodating the refrigerant introduced through the introduction port 133, wherein at least a portion of the introduction chamber I may be formed to be accommodated in the discharge chamber D, wherein at least a portion of the discharge port 131 may be formed to be accommodated in the introduction chamber I, and wherein at least a portion of the introduction port 133 may be formed to be accommodated in the discharge chamber D.

Specifically, the rear housing 130 may include a rear base plate 132 opposite to the center base plate 112, a first annular wall 134 protruding from the rear base plate 132 and located at the outermost side in the radial direction of the rear housing 130, a second annular wall 136 protruding from the rear base plate 132 and accommodated in the first annular wall 134, and a third annular wall 138 protruding from the rear base plate 132 and accommodated in the second annular wall 136, wherein the first annular wall 134, the second annular wall 136, and the third annular wall 138 may be formed to have different heights.

The first annular wall 134 may be formed in an annular shape having a diameter approximately equal to that of the outer periphery of the center base plate 112, may be coupled to the outer periphery of the center base plate 112, and may form the scroll accommodating space S2.

The second annular wall 136 may be formed in an annular shape having a smaller diameter than the first annular wall 134, and may be in contact with the outer periphery of a fixed base plate 510 to be described later, and may form the discharge chamber D.

Here, as the second annular wall 136 is formed to be in contact with a fixed base plate 510 to be described later, when the rear housing 130 is coupled to the center housing 110, fastening force between the center housing 110 and the fixed scroll 500 may be improved by pressing the fixed scroll 500 toward the center housing 110, thus leakage between the fixed scroll 500 and the center housing 110 may be prevented.

The third annular wall 138 may be formed in an annular shape having a smaller diameter than the second annular wall 136, may be spaced apart from a fixed base plate 510 to be described later, and may be covered by a cover plate 710 to be described later, so as to form the introduction chamber I.

And, the third annular wall 138 may include a fastening groove 138*a* into which a fastening bolt 770 fastening the valve mechanism 700 to the third annular wall 138 is inserted, and a first positioning groove 138*b* into which a positioning pin 780 aligning a cover plate 710, first valve 720 and valve plate 730 to be described later to a predetermined position is inserted.

The discharge port 131 is formed in the rear base plate 132, and the discharge port 131 may be extended from a center portion of the rear base plate 132 to one side of an outer periphery of the rear base plate 132 in a radial direction of the rear base plate 132.

In addition, a discharge port inlet 131*a* guiding the refrigerant of the discharge chamber D to the discharge port 131 may be formed in the rear base plate 132.

On the other hand, a tubular oil separator (not illustrated) separating oil from refrigerant is provided inside the discharge port 131, and the oil separator (not illustrated) may be formed so that refrigerant is separated from oil during discharge process in which the refrigerant introduced into the discharge port inlet 131*a* flows to the center side of the rear base plate 132 along a space between an outer circumferential surface of the oil separator (not illustrated) and an inner circumferential surface of the discharge port 131 and then is turned and discharged along an inner circumference of the oil separator (not illustrated) to one side of the outer circumference of the rear base plate 132.

In addition, the introduction port 133 is also formed in the rear base plate 132, the introduction port 133 may be extended from the other side of the outer periphery of the rear base plate 132 to the center portion of the rear base plate 132 in the radial direction of the rear base plate 132, and may be communicated with the introduction chamber I.

Here, as the third annular wall 138 is formed to be accommodated in the second annular wall 136, and the third annular wall 138 is spaced apart from a fixed base plate 510 to be described later and covered by the valve mechanism 700, at least a portion of the introduction chamber I may be accommodated in the discharge chamber D. That is, a side of the introduction chamber I may be formed to overlap the discharge chamber D in the radial direction of the rear housing 130 with the third annular wall 138 interposed therebetween, and an end of the introduction chamber I may be formed to overlap the discharge chamber D in the axial direction of the rear housing 130 with the valve mechanism 700 interposed therebetween.

And, as the discharge port 131 extends from the center portion of the rear base plate 132 to one side of the outer periphery of the rear base plate 132 in the radial direction of the rear base plate 132, at least a portion of the discharge port 131 may be accommodated in the introduction chamber I. That is, at least a portion of the discharge port 131 may be formed to overlap the introduction chamber I in the axial direction of the rear housing 130 with a wall portion of the discharge port 131 interposed therebetween.

And, as the introduction port 133 extends from the other side of the outer periphery of the rear base plate 132 to the center portion of the rear base plate 132 in the radial direction of the rear base plate 132, at least a portion of the introduction port 133 may be accommodated in the discharge chamber D. That is, at least a portion of the introduction port 133 may be formed to overlap the discharge chamber D in the axial direction of the rear housing 130 with a wall portion of the introduction port 133 interposed therebetween.

On the other hand, the discharge port 131 and the introduction port 133 may be formed so that the refrigerant of the discharge port 131 and the refrigerant of the introduction port 133 flow in a cross-flow direction with each other. That is, an angle between an outlet of the discharge port 131 and an inlet of the introduction port 133 with respect to the center of the rear housing 130 may be formed to be greater than or equal to 0 degrees and less than 90 degrees.

As shown in FIG. 2, the motor 200 may include a stator 210 fixed to the front side plate 124 and a rotor 220 rotated by interaction with the stator 210 inside the stator 210.

As shown in FIG. 2, the rotating shaft 300 is coupled to the rotor 220 and passes through a center of the rotor 220, and one end of the rotating shaft 300 passes through the shaft hole of the center base plate 112, and the other end of the rotating shaft 300 may be supported on the front base plate 122.

As shown in FIGS. 2 and 17 to 21, the orbiting scroll 400 may be interposed between the center base plate 112 and the fixed scroll 500, and may include a disk-shaped orbiting base plate 410, an orbiting wrap 420 protruding from a center of the orbiting base plate 410 to the fixed scroll 500, and a boss portion 430 protruding from the center of the orbiting base plate 410 to the opposite side of the orbiting wrap 420 and coupled to the eccentric bush 310.

As shown in FIGS. 2 to 5, 9, 14 to 21, the fixed scroll 500 may include a disk-shaped fixed base plate 510, a fixed wrap 520 protruding from a center of the fixed base plate 510 and engaged with the orbiting wrap 420, and a fixed side plate 530 protruding from an outer periphery of the fixed base plate 510 and coupled to the center base plate 112.

The fixed base plate 510 may include a discharge hole 512 communicating the compression chamber C and the discharge chamber D and a communication hole 514 communicating the compression chamber C and a second flow path 736 to be described later.

The discharge hole 512 is formed as one, and the single discharge hole 512 may be opened and closed by a single discharge valve 600 interposed between the fixed base plate 510 and the valve mechanism 700.

Specifically, the compression chamber C includes a first compression chamber C1 positioned on the distal side in the radial direction of the scroll accommodating space S2 and having a first pressure, a second compression chamber C2 located on the centripetal side in the radial direction of the scroll accommodating space S2 with respect to the first compression chamber C1 and having a second pressure higher than the first pressure, and a third compression chamber C3 located on the centripetal side in the radial direction of the scroll accommodating space S2 with respect to the second compression chamber C2 and having a third pressure higher than the second pressure, wherein each of the first compression chamber C1, the second compression chamber C2, and the third compression chamber C3 may be formed as a pair.

That is, the first compression chamber C1 may include a first outer compression chamber C11 formed by an outer peripheral surface of the orbiting wrap 420 and an inner peripheral surface of the fixed wrap 520, and a first inner compression chamber C12 formed by an inner peripheral surface of the orbiting wrap 420 and an outer peripheral surface of the fixed wrap 520.

And, the second compression chamber C2 may include a second outer compression chamber C21 formed by the outer circumferential surface of the orbiting wrap 420 and the inner circumferential surface of the fixed wrap 520, and a second inner compression chamber C22 formed by the inner circumferential surface of the orbiting wrap 420 and the outer peripheral surface of the fixed wrap 520.

And, the third compression chamber C3 may include, a third outer compression chamber C31 formed by the outer circumferential surface of the orbiting wrap 420 and the inner circumferential surface of the fixed wrap 520, and a third inner compression chamber C32 formed by the inner circumferential surface of the orbiting wrap 420 and the outer peripheral surface of the fixed wrap 520. Here, the third outer compression chamber C31 and the third inner compression chamber C32 may be combined into one in the process of compressing the refrigerant as illustrated in FIGS. 17 to 19.

In this case, the discharge hole 512 may be formed in the center of the fixed base plate 510 to discharge the refrigerant of the third outer compression chamber C31 and the third inner compression chamber C32.

In addition, the discharge valve 600 may include an opening/closing portion 610 for opening and closing the discharge hole 512, a fastening portion 670 fastened to the fixed base plate 510, and a supporting portion 620 extending from the opening/closing portion 610 to the fastening portion 670.

Here, the opening/closing portion 610, the fastening portion 670, and the supporting portion 620 may be each formed as one, and the discharge valve 600 may be fastened to the fixed base plate 510 by one fastening member 680, so that the increase in cost and weight due to the discharge valve 600 is minimized.

Meanwhile, the one fastening member 680 may be preferably fasten to a fixed wrap entry 532 having a relatively large thickness and height to be described later, so that the discharge valve 600 may receive sufficient support even if it is fastened to the fixed base plate 510 by the one fastening member 680.

The communication hole 514 may be formed as a long hole to increase the flow rate of the refrigerant injected into the compression chamber C and increase the flow rate of the refrigerant discharged from the compression chamber C.

In addition, the communication hole 514 may have a uniform cross-sectional shape so that a pressure loss and a flow rate loss do not occur while the refrigerant passes through the communication hole 514. That is, an inner diameter of the communication hole 514 may be formed to a predetermined value regardless of the axial position of the communication hole 514.

In addition, the communication hole 514 may be formed in plurality so that the refrigerant discharged from the valve mechanism 700 is supplied to the pair of second compression chambers C2, and the overcompressed refrigerant is discharged from the pair of second compression chambers C2. That is, the communication hole 514 may include a first communication hole 514*a* capable of communicating with the second outer compression chamber C21 and a second communication hole 514*b* capable of communicating with the second inner compression chamber C22, and the first communication hole 514*a* and the second communication hole 514*b* may be formed on opposite sides with respect to the discharge hole 512.

Here, in order to prevent a pressure imbalance between the second outer compression chamber C21 and the second inner compression chamber C22 from occurring, the communication hole 514 may be formed to communicate with the second outer compression chamber C21 and the second inner compression chamber C22 at the same time. That is, as shown in FIG. 17, when communication between the first communication hole 514*a* and the second outer compression chamber C21 starts, communication between the second communication hole 514*b* and the second inner compression chamber C22 may be started.

And, preferably, the communication hole 514 may be formed to be blocked simultaneously with the second outer compression chamber C21 and the second inner compression chamber C22. That is, as shown in FIG. 20, when the communication between the first communication hole 514*a* and the second outer compression chamber C21 is terminated, the communication between the second communication hole 514*b* and the second inner compression chamber C22 may be terminated.

Meanwhile, the fixed base plate 510 may further include a small-diameter portion insertion groove 516 to prevent refrigerant leakage from occurring at the first communication hole 514*a* and the second communication hole 514*b*. That is, the fixed base plate 510 may further include a first small-diameter portion insertion groove 516*a* into which a first small-diameter portion 732*ab* to be described later is inserted, and a second small-diameter portion insertion groove 516*b* into which a second small-diameter portion 732*bb* to be described later is inserted.

Specifically, the fixed base plate 510 may include a fixed base plate upper surface 510*a* opposite to the valve mechanism 700 and a fixed base plate lower surface 510*b* forming a rear surface of the fixed base plate upper surface 510*a* and opposite to the orbiting scroll 400.

In addition, the first small-diameter portion insertion groove 516*a* is engraved from the fixed base plate upper surface 510*a* toward the fixed base plate lower surface 510*b*, and a first small-diameter portion 732*ab* to be described later is inserted therein, and the first communication hole 514*a* is engraved from the fixed base plate lower surface 510*b* toward the fixed base plate upper surface 510*a* and may communicate with the first small-diameter portion insertion groove 516*a*.

In addition, the second small-diameter portion insertion groove 516*b* is engraved from the fixed base plate upper surface 510*a* toward the fixed base plate lower surface 510*b*, and a second small-diameter portion 732*bb* to be described later is inserted therein, and the second communication hole 514*b* is engraved from the fixed base plate lower surface 510*b* toward the fixed base plate upper surface 510*a* and may communicate with the second small-diameter portion insertion groove 516*b*.

Here, as shown in FIGS. 4 and 5, an inner diameter of the first small-diameter portion 732*ab* (inner diameter of a first portion 736*a* of second flow path to be described later) to be described later may be formed to be greater than or equal to an inner diameter of the first communication hole 514*a*, and the inner diameter of the first small-diameter portion insertion groove 516*a* may be formed at the same level as an outer diameter of the first small-diameter portion 732*ab* to be described later, so that a first small-diameter portion 732*ab* to be described later may be inserted into the first small-diameter portion insertion groove 516*a*, and pressure loss and flow rate loss do not occur while the refrigerant passes through the first communication hole 514*a*. That is, since an outer diameter of the first small-diameter portion 732*ab* to be described later is larger than an inner diameter of the first small-diameter portion 732*ab* to be described later, the inner diameter of the first small-diameter portion insertion groove 516*a* may be larger than the inner diameter of the first communication hole 514*a*.

In addition, an inner diameter of the second small-diameter portion 732*bb* (inner diameter of a second portion 736*b* of second flow path to be described later) to be described later may be formed to be greater than or equal to the inner diameter of the second communication hole 514*b*, and the inner diameter of the second small-diameter portion insertion groove 516*b* may be formed at the same level as an outer diameter of the second small-diameter portion 732*bb* to be described later, so that a second small-diameter portion 732*bb* to be described later may be inserted into the second small-diameter portion insertion groove 516*b*, and pressure loss and flow rate loss do not occur while the refrigerant passes through the second communication hole 514*b*. That is, since an outer diameter of the second small-diameter portion 732*bb* to be described later is larger than an inner diameter of the second small-diameter portion 732*bb* to be described later, the inner diameter of the second small-diameter portion insertion groove 516*b* may be formed to be larger than the inner diameter of the second communication hole 514*b*.

The fixed wrap 520 may be formed to extend, for example, in a logarithmic spiral from the central side of the fixed scroll 500 to the outer peripheral side of the fixed scroll 500.

The fixed side plate 530 may be formed in an annular shape extending along the outer periphery of the fixed base plate 510, and may include a fixed wrap entry 532 connected to the fixed wrap 520 on one side.

In the fixed wrap entry 532, an axial height of the fixed wrap entry 532 may be formed at the same level as an axial height of the fixed wrap 520 so that the refrigerant of the compression chamber C does not leak through the fixed wrap entry 532.

In addition, in the fixed wrap entry 532, a radial thickness of the fixed wrap entry 532 may be formed to be thicker than a radial thickness of the fixed wrap 520 so that the support rigidity of the fixed wrap 520 is improved.

Here, in order to reduce the weight and cost of the fixed scroll 500, the fixed side plate 530 may be formed so that a radial thickness of portion except for the fixed wrap entry 532 is thinner than a radial thickness of the fixed wrap entry 532.

The valve mechanism 700 may be formed on the end surface of the third annular wall 138 to communicate and block between the communication hole 514 and the discharge chamber D and to communicate and block between the introduction chamber I and the communication hole 514.

Specifically, as shown in FIGS. 2 to 5 and 9 to 13, the valve mechanism 700 may include a cover plate 710 fastened to the end surface of the third annular wall 138 to cover the introduction chamber I, a valve plate 730 fastened to the cover plate 710 from the opposite side of the introduction chamber I with respect to the cover plate 710, a first valve 720 interposed between the cover plate 710 and the valve plate 730, and a second valve 790 accommodated in the valve plate 730.

The cover plate 710 may include a cover plate upper surface 710*a* opposite to the introduction chamber I and the third annular wall 138, a cover plate lower surface 710*b* opposite to the valve plate 730 and the first valve 720, and a first valve seating groove 710*c* formed in a concave manner from the cover plate lower surface 710*b* in the center of the cover plate 710.

And, the cover plate 710 may further include a first flow path 712 communicating the introduction chamber I and chamber 734 to be described later, a second fastening hole 714 communicating with the fastening groove 138*a* and passing through the fastening bolt 770, and a first positioning hole 716 communicated with the first positioning groove 138*b* and penetrated by the positioning pin 780.

The first flow path 712 may be formed in the center of the cover plate 710, and may be formed through the cover plate 710 from the cover plate upper surface 710*a* to the first valve seating groove 710*c*.

The second fastening hole 714 may be formed on an outer periphery of the cover plate 710, and may be formed through the cover plate 710 from the cover plate upper surface 710*a* to the cover plate lower surface 710*b*.

The first positioning hole 716 may be formed between the first flow path 712 and the second fastening hole 714 in the radial direction of the cover plate 710, and may be formed through the cover plate 710 from the cover plate upper surface 710*a* to the first valve seating groove 710*c*.

The first valve 720 may be formed to pass the refrigerant of the first flow path 712 to the chamber 734 side and prevent the refrigerant of the chamber 734 from passing through the first flow path 712.

Specifically, the first valve 720 may include a head 722 opening and closing an outlet of the first flow path 712, a leg 724 supporting the head 722, and a periphery 726 supporting the leg 724.

The head 722 may be formed in a disk shape having an outer diameter greater than an inner diameter of the first flow path 712.

The leg 724 may be formed in a plate shape extending from the head 722 to one side of the periphery 726 in one direction.

The periphery 726 may be formed in an annular shape accommodating the head 722 and the leg 724 while being accommodated in the first valve seating groove 710*c*.

In addition, the periphery 726 may include a second positioning hole 726*a* communicating with the first positioning hole 716 and penetrated by the positioning pin 780.

Here, in the first valve 720, an axial thickness of the periphery 726 may be formed to be greater than or equal to an axial depth of the first valve seating groove 710*c* (More precisely, a distance between a base surface of the first valve seating groove 710*c* and a valve plate upper surface 730*a* to be described later), so that the periphery 726 is fixed by being pressed between the first valve seating groove 710*c* and the valve plate 730 without a separate fastening member for fixing the first valve 720. At this time, in order to prevent the case where the periphery 726 is not compressed between the first valve seating groove 710*c* and the valve plate 730 due to tolerance, it may be preferable that the axial thickness of the periphery 726 is designed to be larger than the axial depth of the first valve seating groove 710*c*.

The valve plate 730 may include a valve plate upper surface 730*a* opposite to the cover plate 710 and the first valve 720, and a valve plate lower surface 730*b* opposite to the fixed scroll 500 while forming a rear surface of the valve plate upper surface 730*a*.

In addition, the valve plate 730 may further include a protrusion 732 protruding from the valve plate lower surface 730*b* toward the first communication hole 514*a* and the second communication hole 514*b*. That is, the valve plate 730 may include a first protrusion 732*a* protruding from one side of the valve plate lower surface 730*b* toward the first communication hole 514*a*, and a second protrusion 732*b* protruding from the other side of the valve plate lower surface 730*b* toward the second communication hole 514*b*.

And, the valve plate 730 may further include a chamber 734 serving as a retainer of the first valve 720 and accommodating the refrigerant introduced through the first flow path 712, a first portion 736*a* of second flow path formed in the first protrusion 732*a* and communicating with the first communication hole 514*a*, a second portion 736*b* of second flow path formed in the second protrusion 732*b* and communicating with the second communication hole 514*b*, a first connection flow path 738*a* guiding the refrigerant of the chamber 734 to the first portion 736*a* of second flow path, a second connection flow path 738*b* guiding the refrigerant of the chamber 734 to the second portion 736*b* of second flow path, and a third flow path 737 communicating the chamber 734 and the discharge chamber D.

The valve plate upper surface 730*a* may be formed as a plane in contact with the cover plate lower surface 710*b* and the periphery 726 of the first valve 720.

The chamber 734 may be engraved from the valve plate upper surface 730*a*.

In addition, the chamber 734 may include a retainer surface 734*a* supporting the head 722 and the leg 724 of the first valve 720 when the first valve 720 opens the first flow path 712.

The first portion 736*a* of second flow path may be engraved from the end surface of the first protrusion 732*a* (more precisely, the end surface of the first small-diameter portion 732*ab* to be described later).

The second portion 736*b* of second flow path may be engraved from the end surface of the second protrusion 732*b* (more precisely, the end surface of the second small-diameter portion 732*bb* to be described later).

The first connection flow path 738*a* may be engraved from the valve plate upper surface 730*a*, and may be formed to communicate one side of the chamber 734 and the first portion 736*a* of second flow path.

The second connection flow path 738*b* may be engraved from the valve plate upper surface 730*a*, and may be formed to communicate the other side of the chamber 734 and the second portion 736*b* of second flow path.

In order to suppress an increase in the size of the valve mechanism 700 due to the formation of the third flow path 737, the third flow path 737 may be formed to extend through the valve plate 730 in one direction from the retainer surface 734*a* to the valve plate lower surface 730*b*. That is, an inlet of the third flow path 737 may be formed on the retainer surface 734*a*, and an outlet of the third flow path 737 may be formed on the valve plate lower surface 730*b*.

Here, it may be preferable that the inlet of the third flow path 737 is formed at a position opposite to at least one of the head 722 and the leg 724 of the first valve 720 on the retainer surface 734*a* so that the third flow path 737 suppresses the increase in size of the valve mechanism 700 to the maximum.

However, when the entire inlet of the third flow path 737 is formed at the position opposite to at least one of the head 722 and the leg 724 of the first valve 720, a problem may occur in the function of the valve mechanism 700.

That is, as will be described later, when it is necessary to discharge the overcompressed refrigerant while the first valve 720 is being supported on the retainer surface 734*a* while opening the outlet of the first flow path 712, the overcompressed refrigerant flows from the compression chamber C to the chamber 734 through the communication hole 514, the second flow path 736 and the connection flow path 738, so that the pressure of the chamber 734 may be higher than the pressure of the discharge chamber D. In this case, the first valve 720 should close the first flow path 712 so that the intermediate pressure refrigerant stops flowing into the chamber 734, and the second valve 790 should open the third flow path 737 so that the overcompressed refrigerant in the chamber 734 is discharged to the discharge chamber D.

However, if the entire inlet of the third flow path 737 is formed at the position opposite to at least one of the head 722 and the leg 724 of the first valve 720, when it is necessary to discharge the overcompressed refrigerant while the first valve 720 is being supported on the retainer surface 734*a* while opening the outlet of the first flow path 712, since the first valve 720 blocks the inlet of the third flow path 737, the overcompressed refrigerant in the chamber 734 may not flow to the third flow path 737 and may not be discharged to the discharge chamber D. And, the pressure of the chamber 734 higher than the discharge pressure is applied only to one side of the first valve 720 opposite to the cover plate 710 and does not apply on the other side of the first valve 720 opposite to the retainer surface, so that the first valve 720 may delay closing the first flow path 712, or the first valve 720 may fail to close the first flow path 712.

However, as in this embodiment, if a portion of the inlet of the third flow path 737 is formed at the position opposite to at least one of the head 722 and the leg 724 on the retainer surface 734*a*, and the remaining portion of the inlets of the third flow path 737 is formed at a position that does not face the head 722 and the leg 724 on the retainer surface 734*a*, such problems may be prevented.

Specifically, when it is necessary to discharge the overcompressed refrigerant while the first valve 720 is being supported on the retainer surface 734*a* while opening the outlet of the first flow path 712, the overcompressed refrigerant in the chamber 734 may be introduced into the third flow path 737 through the remaining portion of the inlet of the third flow path 737.

Then, the refrigerant of the chamber 734 is introduced into a first hole 792*a* to be described later of the second valve 790, so that a valve member 794 to be described later of the second valve 790 is moved in a direction away from a first hole 792*a* to be described later, and a first hole 792*a* and a second hole 792*b* to be described later may communicate with each other. That is, the second valve 790 may open the third flow path 737. Accordingly, the overcompressed refrigerant in the chamber 734 may be discharged to the discharge chamber D.

And, when the overcompressed refrigerant in the chamber 734 flows into the third flow path 737 through the remaining portion of the inlet of the third flow path 737 while the first valve 720 is supported by the retainer surface 734*a*, the pressure of the chamber 734 is applied to a portion of the other side of the first valve 720 opposite to the retainer surface to cancel the pressure of the chamber 734 applied to the one side of the first valve 720 opposite to the cover plate 710, so that the head 722 and leg 724 of the first valve 720 that are supported by the retainer surface may be separated from the retainer surface 734*a* by the restoring force of the first valve 720. Then, the pressure of the chamber 734 is applied over the other side of the first valve 720 opposite to the retainer surface, so that the pressure of the chamber 734 applied to the one side of the first valve 720 opposite to the cover plate 710 may be further canceled, restoration of the first valve 720 may be accelerated, and the outlet of the first flow path 712 may be promptly closed by the first valve 720. And, when the outlet of the first flow path 712 is closed by the first valve 720, the closed state of the first flow path 712 is maintained by the pressure difference between the first flow path 712 and the chamber 734, and the intermediate pressure refrigerant may be stopped from flowing to the chamber 734.

Meanwhile, an inner diameter of the inlet of the third flow path 737 may be greater than or equal to an outer diameter of the second valve 790 (more precisely, seat member 792, which will be described later) so that the second valve 790 is inserted into the third flow path 737 through the inlet of the third flow path 737 as will be described later.

On the other hand, an inner diameter of the outlet of the third flow path 737 may be smaller than an outer diameter of the second valve 790 so that the second valve 790 inserted into the third flow path 737 is not separated toward the discharge hole 512.

The second valve 790 may be formed inside the third flow path 737 to prevent interference with the first valve 720 and to reduce the size of the valve mechanism 700.

In addition, the second valve 790 may be formed to pass the refrigerant in the chamber 734 to the discharge chamber D and not to pass the refrigerant in the discharge chamber D to the chamber 734.

Specifically, the second valve 790 may include a seat member 792 forming an exterior of the second valve 790, a valve member 794 provided reciprocally within the seat member 792, and an elastic member 796 applying an elastic force to the valve member 794.

The seat member 792 may be formed in a cylindrical shape having an outer diameter smaller than or equal to the inner diameter of the third flow path 737 and larger than the inner diameter of the outlet of the third flow path 737 so as to be inserted into the third flow path 737 through the inlet of the third flow path 737 and so as not to be separated toward the discharge hole 512 through the outlet of the third flow path 737.

Here, to prevent refrigerant leakage through the outer circumferential surface of the seat member 792 and the inner circumferential surface of the third flow path 737, and to suppress the seat member 792 from being separated from the third flow path 737, a projection in close contact with the inner circumferential surface of the third flow path 737 may be formed on the outer circumferential surface of the seat member 792.

And, the seat member 792 may include a first hole 792*a* communicating with the inlet of the third flow path 737, and a second hole 792*b* having a larger diameter than the first hole 792*a* and communicating with the outlet of the third flow path 737.

The valve member 794 may be formed in a spherical shape having a diameter larger than that of the first hole 792*a* and smaller than that of the second hole 792*b* so as to communicate and block the first hole 792*a* and the second hole 792*b* while reciprocating inside the second hole 792*b*.

The elastic member 796 may be formed as a coil spring pressing the valve member 794 toward the first hole 792*a*.

The valve plate lower surface 730*b* may be formed to be spaced apart from the fixed base plate upper surface 510*a*, so that the discharge valve 600 may be interposed between the fixed base plate upper surface 510*a* and the valve plate lower surface 730*b*, and the refrigerant discharged from the discharge hole 512 may flow into the discharge chamber D.

The first protrusion 732*a* may include a first large-diameter portion 732*aa* protruding from one side of the valve plate lower surface 730*b* toward the first communication hole 514*a*, and a first small-diameter portion 732*ab* more protruding from the first large-diameter portion 732*aa* toward the first communication hole 514*a*.

In the first large-diameter portion 732*aa*, an outer diameter of the first large-diameter portion 732*aa* may be larger than an inner diameter of the first small-diameter portion insertion groove 516*a*, so that the first large-diameter portion 732*aa* may not be inserted into the first small-diameter portion insertion groove 516*a*, and a third sealing member 760 to be described later may be compressed between an end surface of the first large-diameter portion 732*aa* and the fixed base plate upper surface 510*a*.

In the first small-diameter portion 732*ab*, an outer diameter of the first small-diameter portion 732*ab* may be smaller than the outer diameter of the first large-diameter portion 732*aa* and may be formed at the same level as the inner diameter of the first small-diameter portion insertion groove 516*a*, so that the first small-diameter portion 732*ab* may be inserted into the first small-diameter portion insertion groove 516*a*.

And, in the first small-diameter portion 732*ab*, a protrusion length of the first small-diameter portion 732*ab* (the axial distance between the end surface of the first large-diameter portion 732*aa* and an end surface of the first small-diameter portion 732*ab*) may be formed larger than a thickness before deformation of a third sealing member 760 to be described later, and may be formed to be less than or equal to sum of a thickness before deformation of a third sealing member 760 to be described later and the axial depth of the first small-diameter portion insertion groove 516*a*, so that the end surface of the first small-diameter portion 732*ab* may not be in contact with the base surface of the first small-diameter portion insertion groove 516*a*, and a gap between the end surface of the first large-diameter portion 732*aa* and the fixed base plate upper surface 510*a* may be smaller than or equal to a thickness before deformation (thickness before being compressed between the fixed base plate upper surface 510*a* and the end surface of the first large-diameter portion 732*aa*) of a third sealing member 760 to be described later, thus a third sealing member 760 to be described later may be compressed between the end surface of the first large-diameter portion 732*aa* and the fixed base plate upper surface 510*a*. Here, just in case the third sealing member 760, which will be described later, is not compressed between the end surface of the first large-diameter portion 732*aa* and the fixed base plate upper surface 510*a* due to tolerance, it may be desirable to design the protrusion length of the first small-diameter portion 732*ab* to be larger than a thickness before deformation of a third sealing member 760 to be described later and smaller than the sum of a thickness before deformation of a third sealing member 760 to be described later and the axial depth of the first small-diameter portion insertion groove 516*a*.

The second protrusion 732*b* may be formed similarly to the first protrusion 732*a*.

That is, the second protrusion 732*b* may include a second large-diameter portion 732*ba* protruding from the other side of the valve plate lower surface 730*b* toward the second communication hole 514*b*, and a second small-diameter portion 732*bb* more protruding from the second large-diameter portion 732*ba* toward the second communication hole 514*b*.

In the second large-diameter portion 732*ba*, an outer diameter of the second large-diameter portion 732*ba* may be larger than an inner diameter of the second small-diameter portion insertion groove 516*b*, so that the second large-diameter portion 732*ba* may not be inserted into the second small-diameter portion insertion groove 516*b*, and a third sealing member 760 to be described later may be compressed between an end surface of the second large-diameter portion 732*ba* and the fixed base plate upper surface 510*a*.

In the second small-diameter portion 732*bb*, an outer diameter of the second small-diameter portion 732*bb* may be smaller than the outer diameter of the second large-diameter portion 732*ba* and may be formed at the same level as the inner diameter of the second small-diameter portion insertion groove 516*b*, so that the second small-diameter portion 732*bb* may be inserted into the second small-diameter portion insertion groove 516*b*.

And, in the second small-diameter portion 732*bb*, a protrusion length of the second small-diameter portion 732*bb* (the axial distance between the end surface of the second large-diameter portion 732*ba* and an end surface of the second small-diameter portion 732*bb*) may be formed larger than a thickness before deformation of a third sealing member 760 to be described later, and may be formed to be less than or equal to sum of a thickness before deformation of a third sealing member 760 to be described later and the axial depth of the second small-diameter portion insertion groove 516*b*, so that the end surface of the second small-diameter portion 732*bb* may not be in contact with the base surface of the second small-diameter portion insertion groove 516*b*, and a gap between the end surface of the second large-diameter portion 732*ba* and the fixed base plate upper surface 510*a* may be smaller than or equal to a thickness before deformation (thickness before being compressed between the fixed base plate upper surface 510*a* and the end surface of the second large-diameter portion 732*ba*) of a third sealing member 760 to be described later, thus a third sealing member 760 to be described later may be compressed between the end surface of the second large-diameter portion 732*ba* and the fixed base plate upper surface 510*a*. Here, just in case the third sealing member 760, which will be described later, is not compressed between the end surface of the second large-diameter portion 732*ba* and the fixed base plate upper surface 510*a* due to tolerance, it may be desirable to design the protrusion length of the second small-diameter portion 732*bb* to be larger than a thickness before deformation of a third sealing member 760 to be described later and smaller than the sum of a thickness before deformation of a third sealing member 760 to be described later and the axial depth of the second small-diameter portion insertion groove 516*b*.

And, the valve plate 730 may further include a first fastening hole 739*a* formed through the valve plate 730 from the valve plate upper surface 730*a* to the valve plate lower surface 730*b* in the outer periphery of the valve plate 730, to be communicated with the second fastening hole 714, and to be penetrated by the fastening bolt 770.

In addition, the valve plate 730 may further include a second positioning groove 739*b* engraved from the valve plate upper surface 730*a*, to be communicated with the second positioning hole 726*a*, and so that the positioning pin 780 is inserted therein.

Here, the valve mechanism 700 may be aligned by the positioning pin 780, the first positioning hole 716, the second positioning hole 726*a*, the first positioning groove 138*b*, and the second positioning groove 739*b*, and then may be fastened to the rear housing 130 by the fastening bolt 770, the first fastening hole 739*a*, the second fastening hole 714 and the fastening groove 138*a*. That is, one end of the positioning pin 780 passes through the first positioning hole 716 and is inserted into the first positioning groove 138*b*, and the other end of the positioning pin 780 passes through the second positioning hole 726*a* and is inserted into the second positioning groove 739*b*, so that the cover plate 710, the first valve 720, and the valve plate 730 may be arranged at predetermined positions. Then, the fastening bolt 770 passes through the first fastening hole 739*a* and the second fastening hole 714 and is fastened to the fastening groove 138*a*, so that the valve mechanism 700 may be fastened to the rear housing 130.

Meanwhile, as shown in FIGS. 2 to 5 and 9, when the valve mechanism 700 is coupled to the rear housing 130, a first sealing member 740 may be interposed between the cover plate upper surface 710*a* and the third annular wall 138, and a second sealing member 750 may be interposed between the valve plate upper surface 730*a* and the cover plate lower surface 710*b*.

And, as shown in FIGS. 2 to 5 and 13, when the valve mechanism 700 is fastened to the fixed scroll 500, a third sealing member 760 may be interposed between the end surfaces of the large-diameter portions 732*aa*, 732*ba* and the fixed base plate upper surface 510*a*.

Here, in the third sealing member 760, as described above, a thickness before deformation of the third sealing member 760 may be greater than or equal to the gap between the end surfaces of the large-diameter portions 732*aa*, 732*ba* and the fixed base plate upper surface 510*a*, so that the third sealing member 760 may be compressed between the end surfaces of the large-diameter portions 732*aa*, 732*ba* and the fixed base plate upper surface 510*a*.

Meanwhile, unexplained reference numerals 718 and 719 denote a first groove and second groove formed in the cover plate 710, and unexplained reference numerals 518 and 519 denote a third groove and fourth groove formed in the fixed base plate 510.

The first groove 718 is for reducing a contact area between the head 722 of the first valve 720 and the cover plate 710 to reduce collision noise between the head 722 of the first valve 720 and the cover plate 710, and is for preventing foreign substances from being caught between the head 722 of the first valve 720 and the cover plate 710 by collecting and discharging foreign substances, and may be formed in an annular shape surrounding the periphery of the first flow path 712 while being engraved from the first valve seating groove 710*c*, as shown in FIG. 11. And, an inner periphery of the first groove 718 may be formed to overlap an outer periphery of the head 722 of the first valve 720 in the axial direction, and an outer periphery of the first groove 718 may be formed to not overlap the head 722 of the first valve 720 in the axial direction. That is, an inner diameter of the first groove 718 may be smaller than an outer diameter of the head 722 of the first valve 720, and an outer diameter of the first groove 718 may be formed larger than an outer diameter of the head 722 of the first valve 720. Here, the reason that the outer diameter of the first groove 718 is larger than the outer diameter of the head 722 of the first valve 720 is to allow foreign substances collected in the first groove 718 to be discharged to the chamber 734.

The second groove 719 is for collecting and discharging foreign substances to prevent foreign substances from being caught between the leg 724 of the first valve 720 and the cover plate 710, and may be formed to be engraved from the first valve seating groove 710*c* at a position opposite to the leg 724 of first valve 720, as shown in FIG. 11. In addition, the second groove 719 is formed in a long hole shape, a center of the second groove 719 is formed to overlap with the leg 724 of the first valve 720 in the axial direction, and both ends of the second groove 719 may be formed to be non-overlapping with the leg 724 of the first valve 720 in the axial direction. That is, a long axis direction of the second groove 719 and a width direction of the leg 724 of the first valve 720 may be parallel to each other, and a long axis length of the second groove 719 may be formed to be greater than a width of the leg 724 of the first valve 720. Here, the long axis length of the second groove 719 is formed to be greater than the width of the leg 724 of the first valve 720 in order to allow foreign substances collected in the second groove 719 to be discharged into the chamber 734.

Similar to the first groove 718, the third groove 518 is for reducing a contact area between the main opening/closing portion 610 of the discharge valve 600 and the fixed base plate 510 to reduce collision noise between the main opening/closing portion 610 of the discharge valve 600 and the fixed base plate 510, and is for preventing foreign substances from being caught between the main opening/closing portion 610 of the discharge valve 600 and the fixed base plate 510 by collecting and discharging foreign substances, and may be formed in an annular shape surrounding the main discharge hole 512*a* while being engraved from the fixed base plate upper surface 510*a*, as shown in FIGS. 9 and 14. And, an inner periphery of the third groove 518 may be formed to overlap an outer periphery of the opening/closing portion 610 of the discharge valve 600 in the axial direction, and an outer periphery of the third groove 518 may be formed to not overlap the opening/closing portion 610 of the discharge valve 600 in the axial direction. That is, an inner diameter of the third groove 518 may be smaller than an outer diameter of the opening/closing portion 610 of the discharge valve 600, and an outer diameter of the third groove 518 may be greater than an outer diameter of the opening/closing portion 610 of the discharge valve 600. Here, the reason that the outer diameter of the third groove 518 is larger than the outer diameter of the opening/closing portion 610 of the discharge valve 600 is to allow foreign substances collected in the third groove 518 to be discharged to the discharge chamber D.

Similar to the second groove 719, the fourth groove 519 is for collecting and discharging foreign substances to prevent foreign substances from being caught between the supporting portion 620 of the discharge valve 600 and the fixed base plate 510, may be formed to be engraved from the fixed base plate upper surface 510*a* at a position opposite to the supporting portion 620 of the discharge valve 600, as shown in FIGS. 9 and 14. In addition, the fourth groove 519 is formed in a long hole shape, a central portion of the fourth groove 519 is formed to overlap with the supporting portion 620 of the discharge valve 600 in an axial direction, and both ends of the fourth groove 519 may be formed to be non-overlapping the supporting portion 620 of the discharge valve 600 in the axial direction. That is, a long axis direction of the fourth groove 519 and a width direction of the supporting portion 620 of the discharge valve 600 may be parallel to each other, and a long axis length of the fourth groove 519 may be greater than a width of the supporting portion 620 of the discharge valve 600. Here, the long axis length of the fourth groove 519 is formed to be greater than the width of the supporting portion 620 of the discharge valve 600 in order to allow foreign substances collected in the fourth groove 519 to be discharged into the discharge chamber D.

Hereinafter, effects of the scroll compressor according to the present embodiment will be described.

That is, when power is applied to the motor 200, the rotating shaft 300 may rotate together with the rotor 220.

And, the orbiting scroll 400 may be orbitally moved by receiving the rotational force from the rotating shaft 300 through the eccentric bush 310.

Accordingly, the volume of the compression chamber C may be reduced while continuously moving toward the center.

In addition, the refrigerant having a suction pressure may be introduced into the compression chamber C through the suction port (not illustrated), the motor accommodating space S1, the suction flow path (not illustrated), and the scroll accommodating space S2.

In addition, the refrigerant sucked into the compression chamber C may be compressed while moving toward the center along a movement path of the compression chamber C and discharged to the discharge chamber D through the discharge hole 512. That is, when the pressures of the third outer compression chamber C31 and the third inner compression chamber C32 reach the discharge pressure level, the opening/closing portion 610 may open the discharge hole 512.

In addition, the refrigerant of the discharge pressure discharged to the discharge chamber D may be discharged to the outside of the scroll compressor through the discharge port 131.

Here, the scroll compressor according to this embodiment includes the injection flow path (introduction port 133, introduction chamber I, first flow path 712, chamber 734, connection flow path 738, second flow path 736 and communication hole 514) for guiding the intermediate pressure refrigerant to the compression chamber C, and compresses and discharges the refrigerant of suction pressure as well as the intermediate pressure refrigerant, so that the refrigerant discharge amount may be increased than when only the refrigerant of suction pressure is sucked, compressed and discharged. Thereby, the performance and efficiency of the scroll compressor may be improved.

And, it is possible to prevent overcompression by including the pre-outlet flow path (communication hole 514, second flow path 736, connection flow path 738, chamber 734, and third flow path 737) for discharging the overcompressed refrigerant to the discharge chamber D.

And, as the injection flow path and the pre-outlet flow path are partially shared by the valve mechanism 700, the cost and weight may be reduced and design freedom may be significantly improved compared to the case where the injection flow path and the pre-outlet flow path are separately formed.

Specifically, when overcompression does not occur (when the pressure of the second compression chamber C2 is the second pressure), as shown in FIG. 4, since the pressure of the chamber 734 equal to the pressure of the second compression chamber C2 is lower than the pressure of the first flow path 712 (intermediate pressure) and the pressure of the discharge chamber D (discharge pressure), the first valve 720 may open the first flow path 712, and the second valve 790 may close the third flow path 737. That is, the head 722 of the first valve 720 may be moved toward the retainer surface 734*a* by the pressure difference between the chamber 734 and the first flow path 712, so that the outlet of the first flow path 712 may be opened. And, the valve member 794 of the second valve 790 may be moved toward the first hole 792*a* and block between the first hole 792*a* and the second hole 792*b* by the pressure difference between the chamber 734 and the discharge chamber D and the elastic member 796, so that the third flow path 737 may be closed. Then, the refrigerant of the first flow path 712 may be injected into the second compression chamber C2 through the chamber 734, the connection flow path 738, the second flow path 736, and the communication hole 514, and the refrigerant of the chamber 734 can be prevented from being discharged to the discharge chamber D through the third flow path 737.

On the other hand, when overcompression occurs (when the pressure of the second compression chamber C2 exceeds the second pressure), as shown in FIG. 5, the overcompressed refrigerant of the second compression chamber C2 flows to the chamber 734 through the communication hole 514, the second flow path 736, and the connection flow path 738. Thus, the pressure of the chamber 734 may be higher than the pressure of the first flow path 712 (intermediate pressure) as well as the pressure of the discharge chamber D (discharge pressure), the first valve 720 may close the first flow path 712, and the second valve 790 may close the third flow path 737. That is, the head 722 of the first valve 720 may be moved toward the outlet of the first flow path 712 by the pressure difference between the chamber 734 and the first flow path 712 and the restoring force of the first valve 720, and the outlet of the first flow path 712 may be closed. And, the valve member 794 of the second valve 790 may move away from the first hole 792*a* and communicate between the first hole 792*a* and the second hole 792*b* by the pressure difference between the chamber 734 and the discharge chamber, so that the third flow path 737 may be opened. Then, the refrigerant of the first flow path 712 may stop flowing into the chamber 734 so that the injection of the intermediate pressure refrigerant into the compression chamber C may be stopped. In addition, the overcompressed refrigerant flowing from the second compression chamber C2 to the chamber 734 may be discharged to the discharge chamber D through the third flow path 737. Accordingly, the pressure of the second compression chamber C2 is lowered to the second pressure level, and the pressure of the refrigerant discharged from the discharge hole 512 may be prevented from being excessively higher than the discharge pressure. That is, overcompression may be prevented.

Here, the communication hole 514, the second flow path 736, the connection flow path 738, and the chamber 734 are selectively operated as one of the injection flow path and the pre-outlet flow path. That is, an injection hole for injecting intermediate pressure refrigerant into the fixed scroll 500 and a pre-outlet hole for discharging the overcompressed refrigerant are not separately provided. In addition, a separate valve for opening and closing the pre-outlet hole is not provided. That is, the discharge valve 600 is formed to have only a portion for opening and closing the one discharge hole 512 without a portion for opening and closing the pre-outlet hole. Accordingly, the cost required to form the fixed scroll 500 and the discharge valve 600 may be reduced. In addition, the structure of the discharge valve 600 may be simplified, the size may be reduced, and the weight may be reduced. In addition, interference between the injection hole, the pre-outlet hole, and a valve for opening and closing the pre-outlet hole may be prevented in advance, and the design freedom of the communication hole 514 may be greatly improved. That is, the communication hole 514 may be formed at any position on the fixed base plate 510 within a range that does not interfere with the discharge valve 600 of this embodiment that opens and closes only the discharge hole 512. Accordingly, time points at which the communication hole 514 communicates/blocks the compression chamber C may be appropriately adjusted. For example, in this embodiment, the communication hole 514 is formed to communicate/block the second compression chamber C2 so that the intermediate pressure refrigerant is injected relatively late as shown in FIG. 22, but the communication hole 514 is formed to communicate/block the first compression chamber C1 so that the injection timing of intermediate pressure refrigerant may be advanced. In this case, although it is somewhat disadvantageous in terms of overcompression prevention, the refrigerant discharge amount is further increased, so that the performance and efficiency of the scroll compressor may be further improved.

And, in the scroll compressor according to the present embodiment, instead of a separate housing, as the rear housing 130 includes the discharge chamber D and the discharge port 131 as well as the introduction port 133 and the introduction chamber I, that is, as the rear housing 130 having the discharge chamber D, the discharge port 131, the introduction port 133 and the introduction chamber I is integrally formed, the possibility of leakage is reduced, and the size, cost and weight may be reduced.

And, as at least a portion of the introduction chamber I is accommodated in the discharge chamber D, that is, as the side of the introduction chamber I overlaps the discharge chamber D with the third annular wall 138 interposed therebetween, and as the end of the introduction chamber I is overlapped the discharge chamber D with the valve mechanism 700 interposed therebetween, the refrigerant guided to the communication hole 514 may exchange heat with the refrigerant of the discharge chamber D through the third annular wall 138 and the valve mechanism 700. That is, the refrigerant of the introduction chamber I and the refrigerant passing through the valve mechanism 700 may be heated by receiving heat from the refrigerant of the discharge chamber D. Accordingly, it is possible to prevent a liquid refrigerant from being injected into the compression chamber C through the communication hole 514.

And, as at least a portion of the discharge port 131 is accommodated in the introduction chamber I, that is, as at least a portion of the discharge port 131 overlaps the introduction chamber I with the wall portion of the discharge port 131 interposed therebetween, the refrigerant of the introduction chamber I may exchange heat with the refrigerant of the discharge port 131 through the wall portion of the discharge port 131 accommodated in the introduction chamber I. That is, the refrigerant of the introduction chamber I may be heated by receiving heat from the refrigerant of the discharge port 131. Thereby, it is possible to further prevent the liquid refrigerant from being injected into the compression chamber C through the communication hole 514.

And, as at least a portion of the introduction port 133 is accommodated in the discharge chamber D, that is, as at least a portion of the introduction port 133 overlaps the discharge chamber D with the wall portion of the introduction port 133 interposed therebetween, the refrigerant of the introduction port 133 may exchange heat with the refrigerant of the discharge chamber D through the wall portion of the introduction port 133 accommodated in the discharge chamber D. That is, the refrigerant of the introduction port 133 may be heated by receiving heat from the refrigerant of the discharge chamber D. Thereby, it is possible to further prevent the liquid refrigerant from being injected into the compression chamber C through the communication hole 514.

And, as the refrigerant of the discharge port 131 and the refrigerant of the introduction port 133 flow in a cross-flow direction with each other, that is, as the angle between the outlet of the discharge port 131 and the inlet of the introduction port 133 with respect to the center of the rear housing 130 is formed at 0 degrees or more and less than 90 degrees, the refrigerant of the introduction port 133 may exchange heat with the refrigerant of the discharge port 131. That is, the refrigerant of the introduction port 133 may be heated by receiving heat from the refrigerant of the discharge port 131. Thereby, injection of the liquid refrigerant into the compression chamber C through the communication hole 514 may be more effectively prevented.

And, in the valve mechanism 700, as the chamber 734 not only forms a part of the injection flow path and the pre-outlet flow path, but also serves as a retainer of the first valve 720, so that the number of parts, size, cost and weight of the valve mechanism 700 may be reduced.

And, as the first valve 720 is formed in such a way that the periphery 726 of the first valve 720 is pressed and fixed between the cover plate 710 (more precisely, the first valve seating groove 710*c*) and the valve plate 730, a fastening member for fastening the first valve 720 to at least one of the cover plate 710 and the valve plate 730 may be deleted. Thereby, the number of parts, size, cost and weight of the valve mechanism 700 may be further reduced.

And, as the valve mechanism 700 is formed to be fastened to the rear housing 130 at once by the fastening bolt 770 after being pre-aligned by the positioning pin 780, assembling property and assembly quality may be improved.

On the other hand, in above-described embodiment, the orbiting scroll 400 and the fixed scroll 500 are formed to be accommodated in the rear housing 130, but are not limited thereto. That is, the fixed scroll 500 is formed to be exposed to the outside while being interposed between the rear housing 130 and the center housing 110, the orbiting scroll 400 may be accommodated in the fixed scroll 500.

The invention claimed is:

1. A scroll compressor comprising:

a housing;

a motor provided in the housing;

a rotating shaft rotated by the motor;

an orbiting scroll orbitally moved by the rotating shaft;

a fixed scroll forming a compression chamber together with the orbiting scroll; and a valve mechanism guiding intermediate pressure refrigerant from an outside of the housing to the compression chamber and discharging refrigerant overcompressed in the compression chamber into a discharge chamber, wherein the valve mechanism comprises a first flow path through which the intermediate pressure refrigerant flows, a chamber communicating with the first flow path, a second flow path communicating the chamber and the compression chamber, a third flow path communicating the chamber and the discharge chamber, a first valve opening and closing the first flow path, and a second valve opening and closing the third flow path, and wherein the valve mechanism further comprises a cover plate having the first flow path, and a valve plate having the chamber, the second flow path and the third flow path.

2. The scroll compressor of claim 1, wherein the first valve is formed to open the first flow path when the pressure of the chamber is lower than the intermediate pressure, and to close the first flow path when the pressure in the chamber is higher than the intermediate pressure.

3. The scroll compressor of claim 1, wherein the second valve is formed to open the third flow path when a pressure of the chamber is higher than a pressure of the discharge chamber, and to close the third flow path when the pressure in the chamber is lower than the pressure in the discharge chamber.

4. The scroll compressor of claim 1, wherein the first valve is interposed between the cover plate and the valve plate.

5. The scroll compressor of claim 1, wherein the fixed scroll comprises a discharge hole communicating the compression chamber and the discharge chamber, and a communication hole communicating the compression chamber and the second flow path.

6. The scroll compressor of claim 5, wherein a discharge valve is formed in the fixed scroll, and includes an opening/closing portion for opening and closing the discharge hole, a fastening portion fastened to the fixed scroll, and a supporting portion extending from the opening/closing portion to the fastening portion, and wherein the opening/closing portion, the fastening portion, and the supporting portion are each formed as one.

7. A scroll compressor comprising:

a housing;

a motor provided in the housing;

a rotating shaft rotated by the motor;

an orbiting scroll orbitally moved by the rotating shaft;

a fixed scroll forming a compression chamber together with the orbiting scroll; and a valve mechanism guiding intermediate pressure refrigerant from an outside of the housing to the compression chamber and discharging refrigerant overcompressed in the compression chamber into a discharge chamber, wherein the valve mechanism comprises a first flow path through which the intermediate pressure refrigerant flows, a chamber communicating with the first flow path, a second flow path communicating the chamber and the compression chamber, a third flow path communicating the chamber and the discharge chamber, a first valve opening and closing the first flow path, and a second valve opening and closing the third flow path, wherein the second valve is formed inside the third flow path, wherein the first valve comprises a head opening and closing an outlet of the first flow path, a leg supporting the head, and a periphery supporting the leg, and wherein the chamber comprises a retainer surface supporting the head and the leg when the first valve opens the first flow path, and wherein an inlet of the third flow path is formed on the retainer surface.

8. The scroll compressor of claim 7, wherein a first portion of the inlet of the third flow path is formed at a position opposite to at least one of the head and the leg on the retainer surface.

9. The scroll compressor of claim 8, wherein a second portion of the inlet of the third flow path is formed at a position not opposite the head and the leg on the retainer surface.

10. A scroll compressor comprising:

a housing;

a motor provided in the housing;

a rotating shaft rotated by the motor;

an orbiting scroll orbitally moved by the rotating shaft;

a fixed scroll forming a compression chamber together with the orbiting scroll; and a valve mechanism guiding intermediate pressure refrigerant from an outside of the housing to the compression chamber and discharging refrigerant overcompressed in the compression chamber into a discharge chamber, wherein the valve mechanism comprises a first flow path through which the intermediate pressure refrigerant flows, a chamber communicating with the first flow path, a second flow path communicating the chamber and the compression chamber, a third flow path communicating the chamber and the discharge chamber, a first valve opening and closing the first flow path, and a second valve opening and closing the third flow path, wherein the second valve is formed inside the third flow path, wherein the second valve comprises a seat member including a first hole communicating with an inlet of the third flow path and a second hole having a larger diameter than the first hole and communicating with an outlet of the third flow path, a valve member having a diameter larger than the first hole and smaller than the second hole, reciprocating inside the second hole, and communicating and blocking the first hole and the second hole, and an elastic member pressing the valve member toward the first hole.

* * * * *